US008976988B2

(12) United States Patent
Pedersen

(10) Patent No.: US 8,976,988 B2
(45) Date of Patent: Mar. 10, 2015

(54) AUDIO PROCESSING DEVICE, SYSTEM, USE AND METHOD

(75) Inventor: Michael Syskind Pedersen, Smørum (DK)

(73) Assignee: Oticon A/S, Smorum (DK)

( * ) Notice: Subject to any disclaimer, the term of this patent is extended or adjusted under 35 U.S.C. 154(b) by 406 days.

(21) Appl. No.: 13/428,485

(22) Filed: Mar. 23, 2012

(65) Prior Publication Data

US 2012/0243715 A1 Sep. 27, 2012

Related U.S. Application Data

(60) Provisional application No. 61/466,961, filed on Mar. 24, 2011.

(30) Foreign Application Priority Data

Mar. 24, 2011 (EP) ..... 11159555

(51) Int. Cl.
*H04R 25/00* (2006.01)

(52) U.S. Cl.
CPC ..... *H04R 25/505* (2013.01); *H04R 2225/41* (2013.01); *H04R 2225/81* (2013.01); *H04R 2430/03* (2013.01); *H04R 2460/03* (2013.01)
USPC ..... 381/312; 381/320; 381/321

(58) Field of Classification Search
USPC ..... 381/60, 312, 313, 314, 316, 317, 320, 381/321, 94.2, 94.3, 98, 104
See application file for complete search history.

(56) References Cited

U.S. PATENT DOCUMENTS

| | | | | |
|---|---|---|---|---|
| 5,597,380 | A | 1/1997 | McDermott et al. | |
| 6,240,192 | B1 | 5/2001 | Brennan et al. | |
| 6,311,153 | B1 | 10/2001 | Nakatoh et al. | |
| 8,306,241 | B2 * | 11/2012 | Kim et al. | 381/94.3 |
| 8,565,459 | B2 * | 10/2013 | Rasmussen | 381/317 |
| 2004/0258249 | A1 | 12/2004 | Niederdrank et al. | |
| 2006/0013422 | A1 | 1/2006 | Goorevich et al. | |
| 2006/0159285 | A1 | 7/2006 | Reber et al. | |
| 2007/0076910 | A1 | 4/2007 | Sporer | |
| 2009/0017784 | A1 | 1/2009 | Dickson et al. | |

FOREIGN PATENT DOCUMENTS

| | | | |
|---|---|---|---|
| EP | 0985328 | B1 | 3/2006 |
| EP | 2190217 | A1 | 5/2010 |

* cited by examiner

*Primary Examiner* — Huyen D Le
(74) *Attorney, Agent, or Firm* — Birch, Stewart, Kolasch & Birch, LLP

(57) ABSTRACT

An audio processing device includes a) an input unit for converting a time domain input signal to a number $N_I$ of input frequency bands and b) an output unit for converting a number $N_O$ of output frequency bands to a time domain output signal. A signal processing unit processes the input signal in a number $N_P$ of processing channels, smaller than the number $N_I$ of input frequency bands. A frequency band allocation unit allocates input frequency bands to processing channels. A frequency band redistribution unit redistributes processing channels to output frequency bands, and a control unit dynamically controls the allocation of input frequency bands to processing channels and the redistribution of processing channels to output frequency bands.

31 Claims, 9 Drawing Sheets

AUDIO PROCESSING DEVICE, SYSTEM, USE AND METHOD

CROSS REFERENCE TO RELATED APPLICATIONS

This nonprovisional application claims the benefit under 35 USC §119(e) of U.S. Provisional Application No. 61/466,961 filed on Mar. 24, 2011 and under 35 USC §119(a) to European Patent Application No. 11159555.9 filed in the European Patent Office, on Mar. 24, 2011, all of which are hereby expressly incorporated by reference into the present application.

TECHNICAL FIELD

The present application relates to audio processing, in particular to optimizing audio processing to characteristics of a particular input audio signal and/or to a particular user's hearing ability. The disclosure relates specifically to an audio processing device for processing a number $N_I$ of input frequency bands and to a system comprising a number of audio processing devices (e.g. two). The application furthermore relates to the use of an audio processing device and to a method of processing an input audio signal.

The application further relates to a data processing system comprising a processor and program code means for causing the processor to perform at least some of the steps of the method and to a computer readable medium storing the program code means.

The disclosure may e.g. be useful in applications where processing resources are limited, e.g. in portable devices subject to size and/or power consumption constraints. Such applications may include hearing aids, headsets, ear phones, active ear protection systems, handsfree telephone systems, mobile telephones, teleconferencing systems, public address systems, karaoke systems, classroom amplification systems, etc.

BACKGROUND ART

The following account of the prior art relates to one of the areas of application of the present application, hearing aids.

In hearing aids, signals are analyzed and processed in frequency bands. In order to reduce the power consumption, the many frequency bands (often uniformly distributed on the frequency axis) are combined into fewer channels and the processing is done in those combined bands. The result of the processing in each channel may e.g. be a gain, which is redistributed into the many frequency bands, by being multiplied to the signal values of each frequency band and finally synthesized into an output signal.

US 2006/0159285 A1 describes a hearing aid wherein the number of channels in which the signal is processed can be (dynamically) changed, e.g. depending on the acoustic environment or a particular program selection.

U.S. Pat. No. 6,240,192 describes a filter bank structure having the option of varying the number of bands (bandwidth, overlap or non-overlap, etc.).

U.S. Pat. No. 5,597,380 describes a cochlear implant type hearing aid where a number of processing channels is selected from a larger number of input channels in order to provide a balance between the quantity and resolution of information in the frequency domain, and resolution in the time domain.

US 2006/013422 A1 deals with a cochlear implant comprising two types of analysis filter banks for processing different frequency ranges of an input signal differently. Further the number of channels may be selected (e.g. to match the number of electrodes in a particular cochlear implant device). In an embodiment, the number of channels may be increased to enhance any region of the spectrum where finer spectral detail might be required.

U.S. Pat. No. 6,311,153 describes an audio signal compression apparatus comprising frequency warping, whereby a low frequency band, which is auditorily important, can be analyzed with a higher frequency resolution as compared with a high frequency band, whereby efficient signal compression utilizing human auditory characteristics is realized.

US 2009/017784 A1 describes a method of adaptively processing an input signal, the method comprising passing the input signal through an adaptive warped time domain filter to produce an output signal. The scheme has the advantage of flexibility in allowing more selective or non-uniform resolution filters in the filter-bank, for example to mimic the Bark scale, or to reflect critical bands in human hearing.

EP 2 190 217 A1 describes a method of reducing feedback in a hearing aid by multiplying a plurality of upper frequency bands by a random phase.

US 2004/258249 deals with a directional microphone system and the mixing of frequency bands from different microphones.

US 2007/076910 A1 describes cross-over of selected frequency bands from one hearing instrument to another in a binaural hearing aid system.

DISCLOSURE OF INVENTION

Sometimes, the bandwidth of the input signal is smaller than the bandwidth supported by a listening device, e.g. a hearing aid. This is e.g. the case when the input signal is a telephone signal, or other sound signals reproduced from devices with a reduced bandwidth. If such an input signal is detected, it can be advantageous to change the channel coupling so that the number of available (processing) channels only covers the bandwidth of the input signal. Hereby the frequency resolution of some of the channels becomes narrower (finer/better). This is e.g. shown in FIG. 5. Alternatively, the bandwidth of the individual channels can be maintained but the number of channels being processed can be reduced (whereby power can be conserved).

A disadvantage of an instantaneous change of channel coupling may be that some parts of the processing system (such as level estimators) need re-calibration. Hence, corresponding calibration constants should preferably be stored in the listening device, whereby a re-calibration can be performed whenever the channel coupling has been modified. Alternatively, the calibration constants can be re-calculated in the listening device by an algorithm, which is stored in a memory of the listening device.

An object of embodiments of the present application is to provide a flexible audio processing scheme, e.g. adapted to characteristics of the input signal. A further object of embodiments of the present application is to provide an audio processing scheme adapted to a particular user's hearing ability (e.g. based on an audiogram). A further object of embodiments of the present application is to provide an audio processing scheme adapted to optimize power consumption.

Objects of the application are achieved by the invention described in the accompanying claims and as described in the following.

An Audio Processing Device:

In an aspect, an object of the application is achieved by an audio processing device comprising a) an input unit for converting a time domain input signal to a number $N_I$ of input frequency bands and b) an output unit for converting a number $N_O$ of output frequency bands to a time domain output signal. The audio processing device comprises, c) a signal processing unit adapted to process the input signal in a number $N_P$ of processing channels, the number $N_P$ of processing channels being smaller than the number $N_I$ of input frequency bands, d) a frequency band allocation unit for allocating input frequency bands to processing channels, e) a frequency band redistribution unit for redistributing processing channels to output frequency bands, and f) a control unit for dynamically controlling the allocation of input frequency bands to processing channels and the redistribution of processing channels to output frequency bands.

This has the advantage of allowing the audio processing to be optimized to a particular acoustic environment and/or to a user's needs (e.g. hearing impairment) with a view to minimizing power consumption and/or processing frequency resolution. Further, a dynamic allocation of input frequency bands to processing channels is enabled to thereby save processing power and/or to increase frequency resolution and/or to focus frequency resolution, where needed.

The allocation of input frequency bands to processing channels is in the present application referred to as 'band coupling'. The input frequency band allocation (coupling) to processing channels performed in the frequency allocation unit and the redistribution (decoupling) of processing channels to output bands in the frequency band redistribution unit are preferably controlled by one or more control signals from the control unit. A 'user' may in the present context be any user (e.g. an 'average user', average in a hearing ability sense, e.g. a user with an average (normal) hearing ability, e.g. for a particular age or age group) or a particular user (with a particular hearing profile, e.g. with a hearing impairment).

In an embodiment, the control unit comprises a classification unit for identifying characteristics of the input signal, whereby a dynamic allocation of input frequency bands to processing channels can be provided based on characteristics of the input signal.

In an embodiment, characteristics of the input signal comprise its bandwidth. Other characteristics may be its level, e.g. in a particular frequency range or band or its full band level. Other characteristics may include its modulation, e.g. as defined by a modulation index (e.g. a full band modulation index, or band specific indices). In an embodiment, the audio processing device is adapted to provide that the number of processing channels $N_P$ increases with increasing modulation index of the input audio signal. Other characteristics may include a type of signal as e.g. identified by one or more detectors. A type of signal may e.g. be 'speech', 'own voice', 'music', 'traffic noise', 'very noisy' (protection needed), 'party' (many 'competing' voices), 'telephone', 'streamed audio', 'silence', etc.

In an embodiment, the audio processing device comprises a memory storing a number of sets of selectable processing parameters (programs, $Pr_i$, $i=1, 2, \ldots, N_{Pr}$), e.g. optimized for processing different types of input audio signals.

In an embodiment, the number $N_P$ of processing channels is fixed for a given set of processing parameters. The different sets of parameters may be optimized for different types of input audio signals, e.g. speech from one person, speech from several persons, speech in noise, music, telephone conversation, streamed audio, etc. In an embodiment, the number $N_P$ of processing channels is different for at least two sets of different processing parameters. Thereby the number of processing channels may be changed, when a change from one set of processing parameters (here termed a 'program', $Pr_i$, $i=1, 2, \ldots, N_{Pr}$) to another is made (be it automatically or manually initiated, e.g. according to a current listening situation or acoustic environment). Different types of input audio signals are e.g. defined by characteristics of the input signal, such as its bandwidth, its modulation, its pattern of temporal distribution of energy, it comprising mainly music, speech, or noise, or a predefined mixture thereof, etc.

In an embodiment, the number $N_P$ of processing channels is fixed during normal operation of the audio processing device. In an embodiment, the number $N_P$ of processing channels is programmable. In an embodiment, $N_P$ is determined during customization (fitting) of the audio processing device to a particular user. In an embodiment, the number $N_P$ of processing channels is a predetermined fraction of the number $N_I$ of input frequency bands, e.g. $N_P \leq 0.5 \cdot N_I$, such as $N_P \leq 0.25 \cdot N_I$. In an embodiment, the number $N_P$ of processing channels is equal to or smaller than 24, such as equal to or smaller than 16, such as equal to or smaller than 8. In an embodiment, the number $N_P$ of processing channels is fixed for all processing conditions of the audio processing device (e.g. for all sets of processing parameters, and for all modes of operation), e.g. adapted to a particular user's hearing ability.

A fixed number of processing channels may in an embodiment be optimized to cover different frequency ranges of the input signal, e.g. the range or ranges comprising signal components of interest to the user, e.g. the range of a standard telephone signal, or the range(s) where the user has a hearing ability at a certain minimum level (e.g. avoiding cochlear dead frequency regions). In other words, the band allocation is adapted to the input signal and/or the user's hearing ability.

Alternatively, the number $N_P$ of processing channels may be variable for a given set of processing parameters (e.g. for a given program), the variation being e.g. controlled or influenced by other factors, e.g. characteristics of the input signal that do not cause or suggest a change of signal parameters, such variation of characteristics including e.g. variation of bandwidth and/or signal level and/or modulation, possibly on a frequency or band level.

In an embodiment, the number $N_P$ of processing channels is dynamically adapted during normal use of the audio processing device, e.g. depending on the bandwidth of the input signal. In an embodiment, dynamic (e.g. automatic) adaptation of the number of processing channels (e.g. depending on a (time varying) bandwidth of the input audio signal) is implemented in a particular mode of operation of the audio processing device (where a large variation in input bandwidth is expected), whereas a fixed number of processing channels (e.g. determined by the particular set of processing parameters (e.g. a program) selected by the user (or automatically)) is implemented in other mode(s) of operation.

In an embodiment, the number $N_P$ of processing channels is adapted to a user's needs, e.g. a hearing impairment. In an embodiment, the number $N_P$ of processing channels is optimized to a particular user's needs. The number $N_P$ of processing channels (e.g. $N_{P,i}$, for a specific set of processing parameters, $Pr_i$, $i=1, 2, \ldots, N_{PR}$, where $N_{Pr}$ is the number of sets of processing parameters stored in the device) may e.g. be determined during customization (fitting) of the audio processing device to a particular user's needs, e.g. hearing impairment, e.g. depending on the person's audiogram (the audiogram e.g. describing a deviation over the frequency range of operation of the audio device of the person's hearing profile from a normal or standard hearing profile).

In an embodiment, the frequency band allocation unit is adapted to allocate input bands to processing channels according to a user's particular needs. This has the advantage that the resolution in frequency of the processing can be relatively larger where a user can benefit from such high resolution, and relatively smaller where a user cannot benefit from such high resolution. This may be done under the constraint of a fixed number of processing channels, or alternatively varying the number of processing channels according to the user's needs and/or characteristics of the input signal.

In an embodiment, the frequency band allocation unit is adapted to allocate input bands to processing channels in consideration of a psychoacoustic model of the human auditory system (e.g. considering masking effects).

In an embodiment, the frequency band allocation unit is adapted to allocate input bands to processing channels differently for two different sets of processing parameters (programs).

In an embodiment, the frequency band allocation unit is adapted to allocate input bands to processing channels dependent on characteristics of the input signal.

In an embodiment, the frequency band allocation unit is adapted to gradually change (fade) a first band allocation to a second band allocation, when it has been decided to change the present allocation of input bands to processing channels. Fading bands from one channel configuration to another channel configuration (e.g. at a program shift) can e.g. be implemented by slowly (over time) changing the weight of a band in a given channel (e.g. decreasing its weight in one channel and increasing its weight in a neighboring channel, cf. e.g. FIG. 7 and the corresponding discussion). Such fading (e.g. implemented over a time period from 1 s to 10 s, e.g. around 5 s) has the advantage of minimizing artifacts that would otherwise be introduced by an abrupt change of the band coupling. It further allows a re-calibration of various detectors (or estimators) that are influenced by the changing band to channel allocation.

In an embodiment, the audio processing device comprises a memory storing a number of constants or parameters associated with different band coupling schemes (such as level estimators) to allow an appropriate re-calibration of estimators and sensors after a change of band coupling (where e.g. the number of input bands providing input to a given processing channel may change). In an embodiment, sets of calibration constants for given predefined parameter settings and band coupling configurations are stored in the memory. In an embodiment, an algorithm for calculating a set of calibration constants for a given situation may be stored and executed in the audio processing device (e.g. when a band allocation has been changed).

In a preferred embodiment, the allocation of input frequency bands to processing channels is controlled according to a user's hearing impairment, e.g. according to a user's audiogram. This is particularly important for users having a steep decline in hearing ability at specific frequencies (e.g. a so-called SKI-slope hearing loss). In such case it is advantageous to allocate processing channels so that cut-off frequencies of two adjacent channels are located relatively close to a cut-off frequency of the user's audiogram (e.g. where the user's hearing ability starts to decline), cf. e.g. FIG. 4*a*. In an embodiment, the allocation of input frequency bands to processing channels is influenced by a psychoacoustic model customized to a particular hearing impaired person's auditory system.

In an embodiment, a processing channel $PCh_p$ has lower $f_{c,low,p}$ and upper $f_{c,up,p}$ cut-off frequencies, $p=1, 2, \ldots, N_P$. In an embodiment, the frequency band allocation unit is adapted to locate cut-off frequencies of processing bands dependent on a user's hearing impairment. In an embodiment, a (input or output) band is defined by lower and upper cut-off frequencies, e.g. 3 dB cut-off frequencies beyond which energy is attenuated by more than 3 dB, such cut-off frequencies also defining a bandwidth of the band in question (a signal being left largely unaltered (e.g. attenuated less than 3 dB) between the lower and upper cut-off frequency).

In a particular embodiment, the number $N_I$ of input frequency bands is equal to the number $N_O$ of output frequency bands. In an embodiment, the input frequency range is equal to the output frequency range, e.g. 0 to 10 kHz or 0 to 12 kHz. In an embodiment, the number of input and/or output frequency bands are evenly distributed over the input and output frequency range, respectively (i.e. all frequency bands have the same bandwidth, e.g. equal to the total frequency range divided by the number of bands in case of non-overlapping bands). In an embodiment, the number of input and/or output bands is larger than or equal to 16, such as larger than or equal to 32, such as larger than or equal to 64. In an embodiment, the number of input and/or output frequency bands is/are configurable, e.g. during an initial customization of the device to a particular user's needs (e.g. a hearing profile). In an embodiment, the number of input and/or output frequency bands is/are constant (fixed) during normal operation of the device. In an embodiment, the number of input and/or output frequency bands and the number of processing channels is/are constant (fixed) during normal operation of the device. In such case, only the frequency band allocation and re-distribution are changed during normal operation of the device (not the number of frequency bands and processing channels). In an embodiment, the $N_I$ input frequency bands are uniform (have the same width in frequency). In an embodiment, the $N_O$ output frequency bands are uniform (have the same width in frequency).

Alternatively, the number of output bands $N_O$ may be different from the number of input bands $N_I$, e.g. smaller than the number of input bands, e.g. smaller than or equal to the number of channels, e.g. depending on the processing to be performed subsequently and/or of the output transducer of the device (e.g. in case the output transducer comprises a transfer function limited in frequency, e.g. a number of electrodes of a cochlear implant).

In an embodiment, the input unit comprises an analysis unit for splitting a time variant audio input signal into a number $N_I$ of input frequency bands. In an embodiment, the output unit comprises a synthesizer unit for synthesizing a number $N_O$ of output frequency bands into a time variant audio output signal. In an embodiment, the analysis unit comprises an analysis filter bank. In an embodiment, the synthesizer unit comprises a synthesis filter bank. A 'time variant' signal is in the present context taken to mean a signal in the time domain having an amplitude that may vary in time.

In an embodiment, the audio processing device is adapted to provide that the frequency range represented by the (e.g. fixed) number $N_P$ of processing channels is variable. This is e.g. used to provide that the processing channels are working at the frequencies of the input signal that have signal content of importance to a user's perception of the input signal, e.g. depending on the user's hearing impairment and/or characteristics of the signal, e.g. its bandwidth. In an embodiment, only those input frequency bands ($<N_I$) covering the bandwidth of the input signal where significant signal components are present (from a minimum frequency to a maximum frequency of the bandwidth) are allocated to the $N_P$ processing channels. In an embodiment, the input frequency bands covering frequencies represented by a standard telephone channel (e.g. from 50 Hz to 3400 Hz) are allocated to the $N_P$ processing channels. This has the advantage that processing power is optimized to be used only on input frequency bands that contain a useful signal. In an embodiment, components of the input signal of interest to the user (and/or exhibiting significant energy content) may be distributed on (i.e. located in) more than one (separate) frequency range, e.g. in separate frequency bands. Alternatively, the number $N_P$ of processing channels may be adapted to the bandwidth of the input signal, thereby saving power, when an input signal of a lower bandwidth than the input frequency range considered by the audio processing device is identified by the control unit. In an embodiment, input frequency bands corresponding to a frequency range where no useful information is located or where a user cannot hear well (e.g. cochlear dead regions) are not allocated to a processing channel, whereby power can be saved by processing fewer channels.

In an embodiment, the audio processing device is adapted to provide that individual processing channels can represent frequency ranges of the input signal of different width (in that the frequency range of the input signal allocated to a first processing channel may be different in width from the frequency range of the input signal allocated to a second processing channel).

In an embodiment, the audio processing device is adapted to provide that the number of input frequency bands allocated to different processing channels can be different, e.g. to provide that two different processing channels $PCh_i$, $PCh_j$, may represent different numbers of input frequency bands $n_{Ii}$, $n_{Ij}$. In an embodiment, a multitude of input frequency bands are allocated to one processing channel above a first border frequency. In an embodiment, one input frequency band is allocated to one processing channel below a second border frequency. In an embodiment, progressively more input frequency bands are allocated to one processing channel the higher the frequency above a third border frequency. In an embodiment, the first border frequency and the second and/or the third border frequency are identical.

In an embodiment, the audio processing device is adapted to provide that the frequency range(s) $\Delta f_{PC}=[f_{PC,min}; f_{PC,max},]$ (or $\Delta f_{PC}=\Sigma[f_{PC,min,j}; f_{PC,mac,j}]$, j=1, 2, . . . , $N_{PCsc}$, where $N_{PCsc}$ is the number of separate channel frequency ranges) represented by the number $N_P$ of processing channels can be variable in location in frequency and/or in (total) width ($\Delta f_{PC}$). This has the advantage that the channel allocation of the audio processing device can be adapted to a particular user's needs regarding processing only those frequency ranges that comprise useful information and/or significant signal content for him or her.

In an embodiment, the audio processing device is adapted to provide that neighboring input frequency bands and/or processing channels and/or output frequency bands mutually overlap in frequency. Neighboring frequency bands or channels may e.g. overlap more than 10%, such as more than 25%, e.g. up to 50%. In an embodiment, neighboring processing channels have one or more frequency bands in common Such overlap may be advantageous depending on the kind of processing that is performed in a given processing channel.

In an embodiment, the audio processing device is adapted to provide a frequency dependent gain to compensate for a hearing loss of a user.

In an embodiment, the audio processing device comprises an output transducer for converting an electric signal to a stimulus perceived by the user as an acoustic signal. In an embodiment, the output transducer comprises a vibrator of a bone conducting hearing device. In an embodiment, the output transducer comprises a receiver (speaker) for providing the stimulus as an acoustic signal to the user.

In an embodiment, the audio processing device comprises an input transducer for converting an input sound to an electric input signal. In an embodiment, the audio processing device comprises a directional microphone system adapted to separate two or more acoustic sources in the local environment of the user wearing the audio processing device. In an embodiment, the directional system is adapted to detect (such as adaptively detect) from which direction a particular part of the microphone signal originates. This can be achieved in various different ways as e.g. described in U.S. Pat. No. 5,473,701 or in WO 99/09786 A1 or in EP 2 088 802 A1.

In an embodiment, the audio processing device comprises an antenna and transceiver circuitry for wirelessly receiving (and/or transmitting) a direct electric input signal. In an embodiment, the audio processing device comprises a (possibly standardized) electric interface (e.g. a DAI-interface, e.g. in the form of a connector) for receiving (and/or transmitting) a wired direct electric input signal. In an embodiment, the audio processing device comprises demodulation circuitry for demodulating the received direct electric input to provide the direct electric input signal representing an audio signal. In an embodiment, such (time domain) direct electric input signal is used as input to the input unit of the audio processing device. In an embodiment, the audio processing device comprises modulation circuitry for modulating an audio signal to provide signal suitable for being transmitted (e.g. for transmitting the output from the output unit to another device).

In an embodiment, the audio processing device is adapted to receive a frequency domain input audio signal (which is already split into a number $N_I$ of input frequency bands) from another device or component, either via a wired or wireless connection. In an embodiment, the audio processing device is adapted to transmit a frequency domain output audio signal (which is split into a number $N_O$ of output frequency bands) to another device or component, either via a wired or wireless connection. In such embodiments, an (acoustic to electric) input transducer and/or an (electric to acoustic) output transducer may be omitted.

In an embodiment, the audio processing device is adapted to select between (or mix) two time or frequency domain input signals, e.g. an input signal picked up by a microphone system of the audio processing device and an input signal received from another device (e.g. a contralateral hearing instrument of a binaural hearing aid system or an audio gateway associated with the audio processing device).

In an embodiment, the audio processing device comprises a TF-conversion unit for providing a time-frequency representation of the input signal. In an embodiment, the time-frequency representation comprises an array or map of corresponding complex or real values of the signal in question in a particular time and frequency range. In an embodiment, the TF conversion unit comprises a filter bank for filtering a (time varying) input signal and providing a number of (time varying) output signals each comprising a distinct frequency range of the input signal. In an embodiment, the TF conversion unit comprises a Fourier transformation unit for converting a time variant input signal to a (time variant) signal in the frequency domain. In an embodiment, the frequency range considered by the audio processing device from a minimum frequency $f_{min}$ to a maximum frequency $f_{max}$ comprises a part of the typical human audible frequency range from 20 Hz to 20 kHz, e.g. a part of the range from 20 Hz to 12 kHz. The frequency range $f_{min}$-$f_{max}$ considered by the audio processing device is split into a number $N_I$ of input frequency bands, where $N_I$ is e.g. larger than 2, such as larger than 5, such as larger than 10, such as larger than 50, such as larger than 100. The frequency bands may be uniform or non-uniform in width (e.g. increasing in width with frequency), overlapping or non-overlapping according to the application in question.

In an embodiment, the audio processing device comprises a bandwidth detector for determining a bandwidth of an input signal and to provide a bandwidth control signal ($CTR_{BW}$). In an embodiment, the audio processing device is adapted to receive a signal indicating the bandwidth of the input signal ($CTR_{BW}$). Such control signal is used to control or influence the band allocation and band re-distribution of the audio processing device. In an embodiment, the control signal is (e.g. wirelessly) received from another device, e.g. from a mobile telephone or an audio gateway. In an embodiment, such control signal ($CTR_{BW}$) indicating the bandwidth of an input audio signal is embedded in the input audio (stream) signal itself, and the audio processing device is adapted to extract the control signal from the input audio signal.

In an embodiment, the audio processing device comprises a level detector (LD) for determining the level of the input signal and for providing a LEVEL parameter. The level detector(s) may either work on the full bandwidth signal or on band split signals (or both). The input level of an electric microphone signal picked up from a user's acoustic environment is a classifier of the environment. The input level(s) may form part of the characteristics of the input signal. In an embodiment, the level detector is adapted to classify a current acoustic environment of the user as a HIGH-LEVEL or a LOW-LEVEL environment (or in more than two steps). Level detection in hearing aids is e.g. described in WO 03/081947 A1 or U.S. Pat. No. 5,144,675. Preferably, each processing channel comprises a level detector that is adapted to be re-calibrated, when needed, e.g. (automatically) in connection with a change of band allocation.

In a particular embodiment, the audio processing device comprises a voice (or speech) detector (VD) for determining whether or not the input signal comprises a voice signal (at a given point in time). A voice signal is in the present context taken to include a speech signal from a human being. It may also include other forms of utterances generated by the human speech system (e.g. singing). In an embodiment, the voice detector unit is adapted to classify a current acoustic environment of the user as a VOICE or NO-VOICE environment. This has the advantage that time segments of the electric microphone signal comprising human utterances (e.g. speech) in the user's environment can be identified, and thus separated from time segments only comprising other sound sources (e.g. artificially generated noise). In an embodiment, the voice detector is adapted to detect as a VOICE also the user's own voice. Alternatively, the voice detector is adapted to exclude a user's own voice from the detection of a VOICE. Voice detection may form part of the characteristics of the input signal, and may e.g. define a type of the signal.

In an embodiment, the audio processing device comprises an own voice detector for detecting whether a given input sound (e.g. a voice) originates from the voice of the user of the system. Own voice detection is e.g. dealt with in US 2007/009122 and in WO 2004/077090. In an embodiment, the microphone system of the audio processing device is adapted to be able to differentiate between a user's own voice and another person's voice and possibly from NON-voice sounds. Own voice detection may form part of the definition of the characteristics or type of the input signal.

In an embodiment, the audio processing device comprises an acoustic (and/or mechanical) feedback suppression system. Frequency dependent acoustic, electrical and mechanical feedback identification methods are commonly used in audio processing devices, in particular hearing instruments, to ensure their stability. A feedback suppression system preferably includes adaptive feedback estimation and cancellation having the ability to track feedback path changes over time and e.g. being based on a linear time invariant filter for estimating the feedback path wherein filter weights are updated over time. The filter update may be calculated using stochastic gradient algorithms, including some form of the popular Least Mean Square (LMS) or the Normalized LMS (NLMS) algorithms.

Various aspects of adaptive filters are e.g. described in [Haykin] (S. Haykin, Adaptive filter theory (Fourth Edition), Prentice Hall, 2001). Feedback path estimation may e.g. be performed fully or partially on sub-band signals.

In an embodiment, the frequency band allocation unit is adapted to allocate input bands to processing channels dependent on an estimate of the feedback path. In an embodiment, the allocation is based on an estimate of the feedback path averaged over a relatively long time period, e.g. minutes or hours. Thereby gain margin may be optimized.

In an embodiment, the audio processing device further comprises other relevant functionality for the application in question, e.g. compression, noise reduction, etc.

In an embodiment, the audio processing device comprises a listening device, e.g. a hearing instrument, a headset, an ear phone, an active ear protection system, a handsfree telephone system, a mobile telephone, a teleconferencing system, a public address system, a karaoke system, a classroom amplification systems or a combination thereof.

In an embodiment, the audio processing device, e.g. a listening device, comprises an ITE-part adapted for being placed in the ear of a user. In an embodiment, the ITE-part comprises a vent. In an embodiment, the ITE-part comprises a vent of variable size (such as variable cross-sectional area). In an embodiment, the frequency band allocation unit of the audio processing device is adapted to allocate input bands to processing channels dependent on the cross-sectional area of the vent. In an embodiment, the listening device is adapted to provide a relatively lower frequency resolution of the lower processing channels, the larger the vent size. In other words, more (low frequency) input frequency bands are associated with the same processing channel the larger the vent size. A hearing aid with a variable vent size is e.g. described in EP2071872.

An Audio Processing System:

In an aspect, an audio processing system comprising two or more audio processing devices as described above, in the detailed description of 'mode(s) for carrying out the invention' and in the claims is provided. In an embodiment, the audio processing system comprises two audio processing devices, e.g. hearing aids, which are adapted for exchanging information between them, preferably via a wireless communication link. In an embodiment, the audio processing system comprises a binaural hearing aid system comprising first and second hearing instruments adapted for being located at or in left and right ears of a user. In an embodiment, the two audio processing devices are adapted to allow the exchange of status signals, e.g. including the transmission of characteristics of the input signal received by a device at a particular ear to the device at the other ear. In an embodiment, the two audio processing devices are, additionally or alternatively, adapted to allow the exchange of audio signals (or at least a part of the frequency range of the audio signals) between them, e.g. so that an input audio signal (or a part thereof) received by a particular device (or possibly after processing in the device in question) may be transmitted to the other device, and vice versa. In an embodiment, the two audio processing devices are adapted to transmit to and receive from the respective other device level-estimates and/or bandwidth estimates and/or modulation characteristics of the received input audio signals of the devices in question. In an embodiment, the two audio processing devices are adapted to provide different frequency band allocation and redistribution schemes for the two devices of the system, thereby allowing a specific adaptation of the system to possible different hearing profiles of a left and right ear of a user (or to distinct different acoustic environmental conditions of the left and right ear of a user, e.g. in an 'asymmetrical' acoustic environment, e.g. in a vehicle). Alternatively, the audio processing system is adapted to provide that the same band coupling scheme is applied in both devices of a binaural system (e.g. by exchanging synchronizing control signals between the two devices, e.g. so that both devices use the same set of processing parameters at a given time (and thus apply the same band coupling scheme)). Such scheme would generally be appropriate in a system where the user of the system has a symmetric hearing ability in the situation in question (e.g. if the user has a substantially identical hearing loss on both ears, which is often the case). In an embodiment, both audio devices comprise one or more sensors for sensing the same parameter(s), e.g. sensors of speech, music, etc. and where the system is adapted to base a conclusion concerning the current acoustic environment on the sensor measurements from both devices, e.g. in that both sensors agree to the same conclusion or that an average value is calculated. In an embodiment, the audio processing system comprises an audio gateway device for receiving a number of audio signals from a number of different audio sources and for transmitting a selected one of the received audio signals to the audio processing devices.

A Method of Processing an Input Audio Signal:

In an aspect, a method of processing an input audio signal is furthermore provided.

The method comprises a) providing the input signal in a number NI of input frequency bands;

b) allocating the number NI of input frequency bands to a number NP of processing channels, each comprising a channel input signal, the number NP of processing channels being smaller than the number NI of input frequency bands;

c) processing the number NP of channel input signals and providing a number NP of channel output signals;

d) redistributing the number NP of processing channels to a number NO of output frequency bands;

wherein the allocation of input frequency bands to processing channels and the redistribution of processing channels to output frequency bands are dynamically controlled.

It is intended that the structural features of the device described above, in the detailed description of 'mode(s) for carrying out the invention' and in the claims can be combined with the method, when appropriately substituted by a corresponding process. Embodiments of the method have the same advantages as the corresponding devices.

In an embodiment, the method further comprises converting a time domain input signal into the number $N_I$ of input frequency bands. In an embodiment, the method further comprises converting the number $N_O$ of output frequency bands to a time domain output signal.

A Computer-Readable Medium:

A tangible computer-readable medium storing a computer program comprising program code means for causing a data processing system to perform at least some (such as a majority or all) of the steps of the method described above, in the detailed description of 'mode(s) for carrying out the invention' and in the claims, when said computer program is executed on the data processing system is furthermore provided by the present application. In addition to being stored on a tangible medium such as diskettes, CD-ROM-, DVD-, or hard disk media, or any other machine readable medium, the computer program can also be transmitted via a transmission medium such as a wired or wireless link or a network, e.g. the Internet, and loaded into a data processing system for being executed at a location different from that of the tangible medium.

A Data Processing System:

A data processing system comprising a processor and program code means for causing the processor to perform at least some (such as a majority or all) of the steps of the method described above, in the detailed description of 'mode(s) for carrying out the invention' and in the claims is furthermore provided by the present application.

Further objects of the application are achieved by the embodiments defined in the dependent claims and in the detailed description of the invention.

As used herein, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element or intervening elements may be present, unless expressly stated otherwise. Furthermore, "connected" or "coupled" as used herein may include wirelessly connected or coupled. As used herein, the term "and/or" includes any and all combinations of one or more of the associated listed items. The steps of any method disclosed herein do not have to be performed in the exact order disclosed, unless expressly stated otherwise.

BRIEF DESCRIPTION OF DRAWINGS

The disclosure will be explained more fully below in connection with a preferred embodiment and with reference to the drawings in which.

The figures are schematic and simplified for clarity, and they just show details which are essential to the understanding of the disclosure, while other details are left out.

Further scope of applicability of the present disclosure will become apparent from the detailed description given hereinafter. However, it should be understood that the detailed description and specific examples, while indicating preferred embodiments of the disclosure, are given by way of illustration only. Other embodiments may become apparent to those skilled in the art from the following detailed description.

MODE(S) FOR CARRYING OUT THE INVENTION

In the following the terms 'frequency band' and frequency band signal (associating a frequency band with its contents) are used interchangeably.

FIG. 1 shows three different embodiments of an audio processing device according to the present disclosure. All three embodiments comprise an input unit IU receiving a time domain electric input signal IN and an output unit OU for generating a time domain output signal OUT. The input unit IU is adapted to split or convert the time domain electric input signal IN to $N_I$ (time varying) signals $IFB_1, IFB_2, \ldots, IFB_{NI}$, each representing a frequency or frequency range, here referred to as $N_I$ input frequency bands. The input unit IU may e.g. be implemented as an (possibly uniform) analysis filter bank, e.g. by means of a Fourier transformation unit (e.g. an FFT-unit or any other domain transform unit). The output unit OU is adapted for generating a time domain output signal OUT from a number $N_O$ of (time varying) signals $OFB_1, OFB_2, \ldots, OFB_{NO}$, each representing a frequency or frequency range, here referred to as $N_O$ output frequency bands. In a preferred embodiment, $N_I=N_O$. In a preferred embodiment, the input and/or output frequency bands are uniform (i.e. of equal width). The neighboring input frequency bands and/or processing channels and/or output frequency bands may or may not mutually overlap in frequency. The output unit OU may e.g. be implemented as a (possibly uniform) synthesis filter bank, e.g. by means of an inverse Fourier transformation unit (e.g. an IFFT unit or any other appropriate inverse domain transform unit).

A control and processing unit for processing the input signal in a number of processing channels $N_P$ is located between the input unit IU and the output unit OU. The control and processing unit receives as inputs $N_I$ input frequency bands $IFB_1, IFB_2, \ldots, IFB_{NI}$, and provides as outputs $N_O$ output frequency bands $OFB_1, OFB_2, \ldots, OFB_{NO}$, the output frequency bands comprising processed versions of the input frequency bands, an output band being e.g. equal to an input band modified by an appropriate (possibly complex) gain (or attenuation).

Figure 1A:
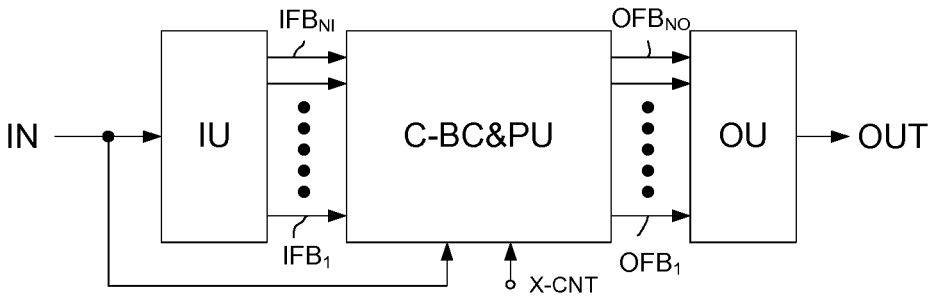
FIG. 1 shows three different embodiments of an audio processing device according to the present disclosure.

The control and processing unit is represented in the embodiment of FIG. 1*a* by block C-BC&PU. In addition to the frequency split input signal in the form of $N_I$ input frequency band signals, $IFB_1, IFB_2, \ldots, IFB_{NI}$, the control and processing unit C-BC&PU, also receives the time domain (wideband) input signal IN. The control and processing unit C-BC&PU provides an allocation of the $N_I$ input frequency bands to $N_P$ processing channels, which are processed to provide enhanced signals, which—after processing—are redistributed to $N_O$ output frequency band signals $OFB_1, OFB_2, \ldots, OFB_{NO}$, forming output signals of the control and processing unit C-BC&PU and fed to the output unit OU. The control and processing unit C-BC&PU may base the allocation and redistribution of input and output frequency bands, respectively, and the signal processing itself, on one or more of the input signals IN and $IFB_1, IFB_2, \ldots, IFB_{NI}$, and additionally on one or more other input signals X-CNT, e.g. including an external input, e.g. (wirelessly) received from another device or from a sensor in the audio processing device itself. The control and processing unit C-BC&PU may extract characteristics of the input signal (IN and/or $IFB_1, IFB_2, IFB_{NI}$), e.g. bandwidth and/or level, etc., which may influence the allocation/redistribution process (possibly including deciding on an appropriate number of processing channels $N_P$ for the inputs signal in question). Alternatively, such characteristics may be extracted elsewhere and received as inputs X-CNT to the control and processing unit C-BC&PU. Such characteristics may e.g. be received from an external device, e.g. from a transmitter located in a particular room where a user of the audio processing device is expected to enter, or from another, e.g. mobile, device, e.g. from a contralateral device of a binaural hearing aid system or from a remote control and/or an audio gateway associated with the audio processing device(s) in question. The one or more further inputs X-CNT to the control and processing unit (C-BC&PU in FIG. 1*a*; CTR in FIGS. 1*b* and 1*c*) may e.g. comprise signals relating to the present cognitive load of the user of the audio processing device. Methods of estimating present cognitive load and possible appropriate actions regarding processing in a hearing instrument are e.g. discussed in EP2200347A2. In an embodiment, the band allocation is influenced by a user's hearing impairment, e.g. an audiogram (cf. e.g. FIG. 4 and corresponding description) or by other measurements related to the user's auditory perception and/or mental state (e.g. estimates of a user's current cognitive load, a psychoacoustic model, etc.). In an embodiment, the audio processing device, e.g. the control and processing unit C-BC&PU comprises a memory storing a number of sets of processing parameters (programs, $Pr_i$, i=1, 2, . . . , $N_{Pr}$) adapted for being executed by the control and processing unit and e.g. optimized to particular acoustic environments or specific types of input audio signals. A change of program may e.g. be automatically initiated by the audio processing device based on a classification of the present auditory environment or manually by a user. In an embodiment, a change of program initiates a change of the band coupling (allocation of frequency bands to processing channels). Alternatively or additionally, a change of the band coupling may be initiated by the identification of specific characteristics of the input signal (e.g. its bandwidth) and/or by a sensor (e.g. a magnetic field sensor) sensing an input from a telephone apparatus, indicating that a reduced bandwidth input signal is present. Preferably, the memory also stores a number of constants or parameters associated with the different band coupling schemes (such as level estimators) to allow an appropriate re-calibration of estimators and sensors after a change of band coupling (where e.g. the number of input bands providing input to a given processing channel may change).

Figure 9:
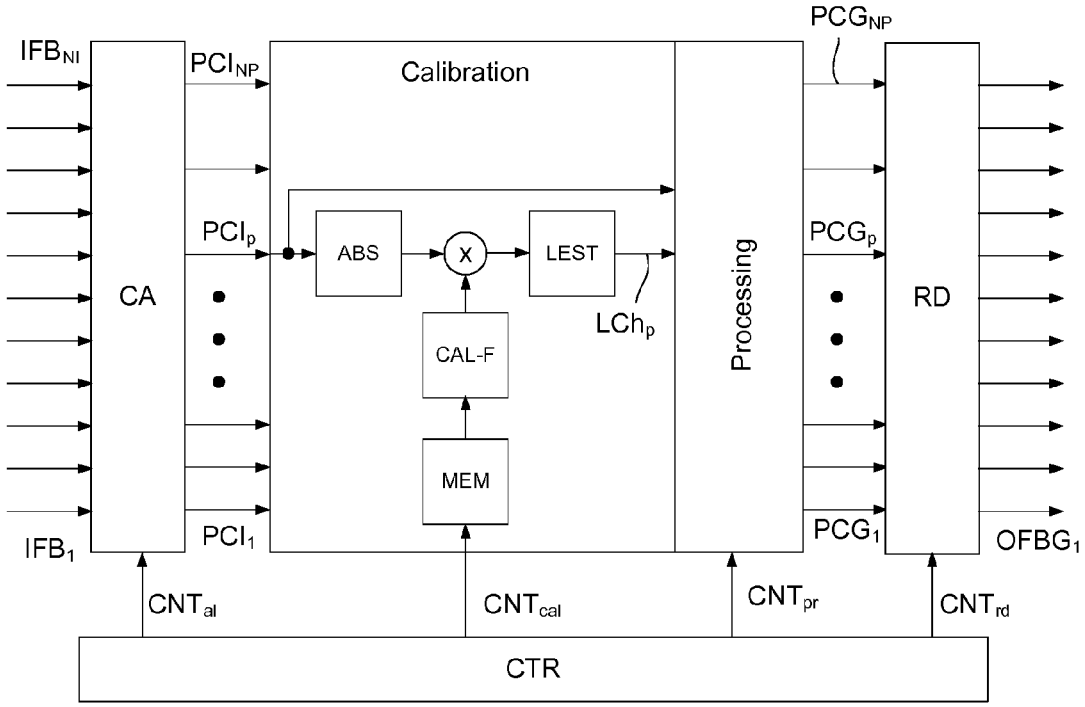
FIG. 9 shows an example of an audio processing device comprising a calibration unit.

If for example the band coupling of an audio processing device is changed (e.g. in connection with a program change) or if a time constant of a level estimator is changed, it is typically necessary to re-calibrate internal level estimators in the audio processing device (to adapt the level estimator of a processing channel to a changed allocation of input bands to the processing channel in question), see e.g. FIG. 9.

Figure 1B:
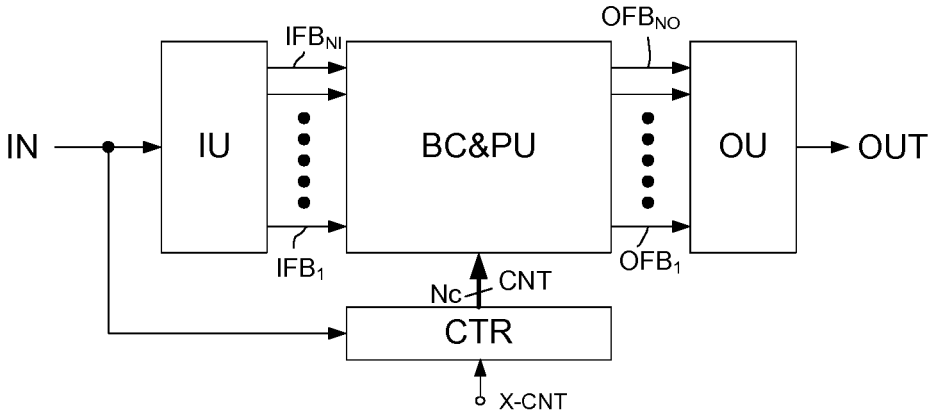
Figure 1C:
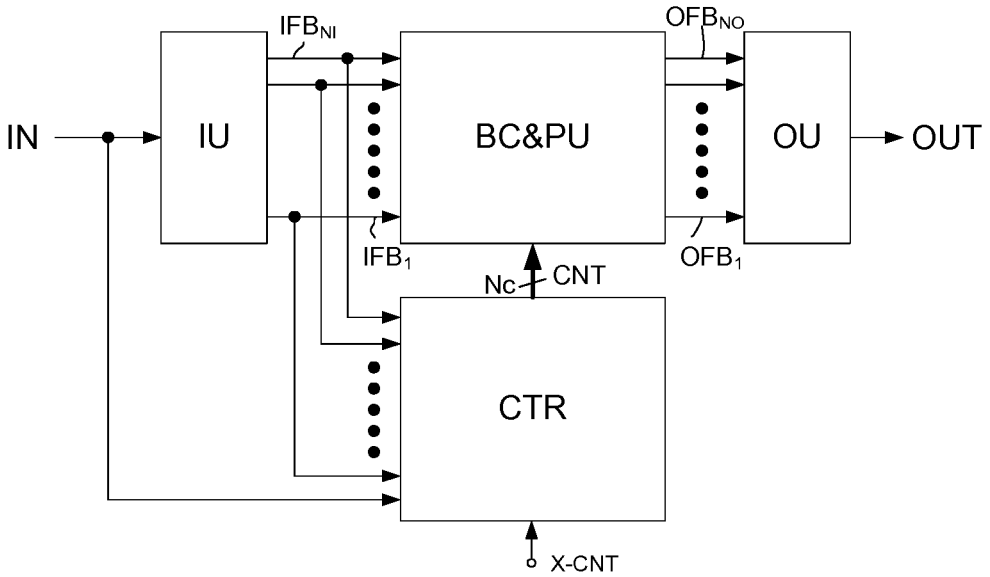

The embodiments shown in FIGS. 1*b* and 1*c* are equivalent to the one shown in FIG. 1*a*. The only difference is that the control and processing unit C-BC&PU of FIG. 1*a* is split into a control unit CTR and a band coupling and processing unit BC&PU in the embodiments of FIGS. 1*b* and 1*c*. The control unit CTR for controlling the band coupling and redistribution of input and output frequency bands, respectively, to and from processing channels in the band coupling and processing unit BC&PU receives input signals and provides control signals CNT (indicated to comprise a number $N_c$ of control signals, $N_c \geq 1$) to the band coupling and processing unit BC&PU. In the embodiment of FIG. 1*b*, the input signals to the control unit CTR comprise the time domain input audio signal IN, and one or more further inputs X-CNT. In the embodiment of FIG. 1*c*, the input signals to the control unit CTR may include the time domain input audio signal IN, and/or one or more of the input frequency band signals $IFB_1$, $IFB_2$, . . . , $IFB_{NI}$, and/or one or more further inputs X-CNT.

Figure 2:
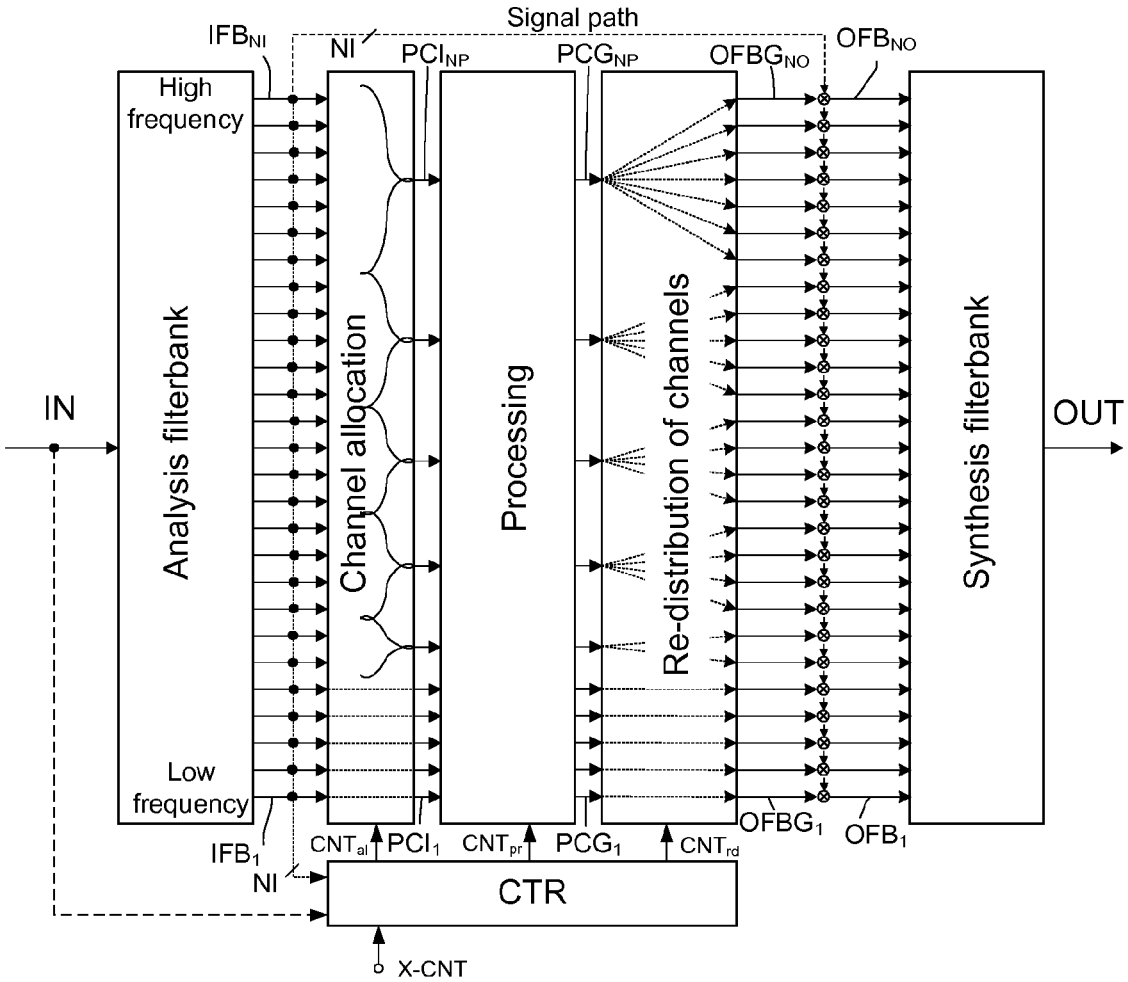
FIG. 2 shows an embodiment of an audio processing device according to the present disclosure.

FIG. 2 shows an embodiment of an audio processing device according to the present disclosure. The embodiment of FIG. 2 is similar in structure to the one shown FIG. 1*c*. In FIG. 2, the input unit IU is implemented as an Analysis filterbank to split the input signal IN into a number of input frequency bands, which are fed to a Channel allocation unit. The output unit OU of FIG. 1*c* is in the embodiment of FIG. 2 implemented as a Synthesis filterbank. The band coupling and processing unit BC&PU of FIG. 1*c* is in the embodiment of FIG. 2 implemented by a Channel allocation unit, a Processing unit, a Re-distribution of channels unit and a string of combination units (here multiplication units '×') operationally coupled to each other. The control unit CTR is adapted to fully or partially control the three blocks Channel allocation unit, Processing unit, and Re-distribution of channels unit via respective control signals $CNT_{al}$, $CNT_{Pr}$ and $CNT_{rd}$.

The input audio signal IN (e.g. received from a microphone system or a wireless transceiver) has its energy content below an upper frequency in the audible frequency range of a human being, e.g. below 20 kHz. The audio processing device is typically limited to deal with signal components in a subrange [$f_{min}$; $f_{max}$] of the human audible frequency range, e.g. to frequencies below 12 kHz and/or frequencies above 20 Hz. In the Analysis filterbank of FIG. 2, the input frequency bands $IFB_1$, $IFB_2$, $IFB_{NI}$ representing the frequency range from $f_{min}$ to $f_{max}$ of the input signal considered by the audio processing device are indicated by arrows from the Analysis filterbank to the Channel allocation unit with increasing frequencies from bottom (Low frequency) to top (High frequency) of the drawing. The Channel allocation unit is adapted to couple input frequency bands $IFB_1$, $IFB_2$, . . . , $IFB_{NI}$ to a reduced number of processing channels $PCh_1$, $PCh_2$, . . . , $PCh_{NP}$ (with input signals $PCI_1$, $PCI_2$, . . . , $PCI_{NP}$) controlled by allocation input control signal $CNT_{al}$ as (schematically) indicated by the arrows and curly brackets in the Channel allocation unit and between the Channel allocation unit and the Processing unit. Each input signal $PCI_p$ to its respective processing channel $PCh_p$ comprises e.g. a complex number representing a magnitude and phase of the signal in the $p^{th}$ channel (at a particular time instant). The value of the signal in the $p^{th}$ channel is e.g. a weighted combination of the values of the contents of input bands $IFB_i$ that are allocated to the $p^{th}$ channel (cf. e.g. description in connection with FIG. 7). In the embodiment of FIG. 2, the 5 lowest input frequency bands are each allocated to their own processing channel, whereas for the higher input frequency bands more than one input frequency band are allocated to the same processing channel. In the exemplary embodiment of FIG. 2, the number of input frequency bands allocated to the same processing channel is increasing with increasing frequency, here so that the first processing channel above the one-to-one mapping of input frequency bands to processing channels represents two input frequency bands, the next three bands, the next four, and so forth. Any other allocation may be appropriate depending on the application, e.g. depending on the input signal, on the user, on the environment, etc.

In the Processing unit the signals of each processing channel are separately dealt with. Processing may e.g. include applying directional information to the input signal in each channel, applying noise reduction algorithms, level compression algorithms, feedback estimation or the like to the signals of each channel. By (possibly dynamically) controlling the number of processing channels and/or the allocation of input frequency bands to processing channels, the available processing power may e.g. be focused to the most important frequency ranges of the input signal, such focusing being e.g. dependent on characteristics of the input signal, the user (e.g. a hearing impairment) and/or the environment or use of the audio processing device. In general, the processing tasks performed by the processing unit (in a limited number of processing channels) can be selected (e.g. prior to operation or dynamically by a control unit) with a view to optimizing processing power (e.g. to maximize a benefit to power ratio). Processing tasks that benefit from being executed on the full signal (e.g. in the time domain) and processing tasks that benefit from being executed in all input frequency bands of the signal can be performed in other parts of the audio processing device than in the Processing unit of the embodiment of FIG. 2 (or BC&PU of FIG. 1). Other processing units or algorithms may thus be included/applied to the signal path prior to or after the processing performed in the Processing unit of FIG. 2 (or 3). Such processing may be performed in the frequency domain and/or in the time domain as found appropriate in the application in question.

The contents of the output signals $PCG_1$, $PCG_2$, . . . , $PCG_{NP}$ of processing channels $PCh_1$, $PCh_2$, . . . , $PCh_{NP}$ after processing in the Processing unit are fed to the Re-distribution of channels unit as indicated by arrows between the two units in FIG. 2. The channel processing may e.g. result in a channel gain (or attenuation) factor $PCG_p$. During re-distribution in the Re-distribution of channels unit (controlled by control input signal $CNT_{rd}$ from control unit CTR), the calculated resulting gain factor $PCG_p$ for a particular processing channel p is copied to identical output frequency band gain factors $OFBG_{pq}$ (q=1, 2, . . . , $N_{cp}$), which serve as inputs to a number of combination units '×' (e.g. multiplication units, if the gain is a factor (not in dB)) corresponding to the number of output frequency bands $N_{cp}$, which a given processing channel p is to be split into, to thereby provide the appropriate total number $N_O$ of output frequency band gain factors $OFBG_j$ (j=1, 2, . . . , $N_O$). The re-distribution of channels to output frequency bands (and corresponding copying of channel processing gain factors PCG to output frequency band gain factors OFBG) is indicated by dotted arrows from input to output of the Re-distribution of channels unit. The resulting output frequency band gain factors $OFBG_j$ are applied to the input frequency band signals $IFB_j$ (j=1, 2, . . . , $N_I$) in combination units 'x' between the Re-distribution of channels unit and the Synthesis filterbank to provide the output frequency band signals $OFB_J$ (j=1, 2, . . . , $N_O$). The connections of the input frequency band signals to corresponding combination units '×' are indicated in FIG. 2 by the dashed connection denoted Signal path from the outputs of the Analysis filterbank to inputs of the string of combination units '×' intended to combine respective input frequency band signals $IFB_j$ with respective output frequency band gain factors $OFBG_j$ to form respective output frequency band signals $OFB_j$. In the present embodiment, the number of input frequency bands $N_I$ is equal to the number $N_O$ of output frequency bands, so that $OFB_j = OFBG_j \cdot$ (j=1, 2, . . . , $N_I = N_O$).

The Synthesis filterbank combines the output frequency bands to an output signal OUT in the time domain. The output signal OUT may e.g. be further processed by other processing algorithms, transmitted to another device and/or presented to a user via an appropriate output transducer, e.g. a speaker.

Figure 3:
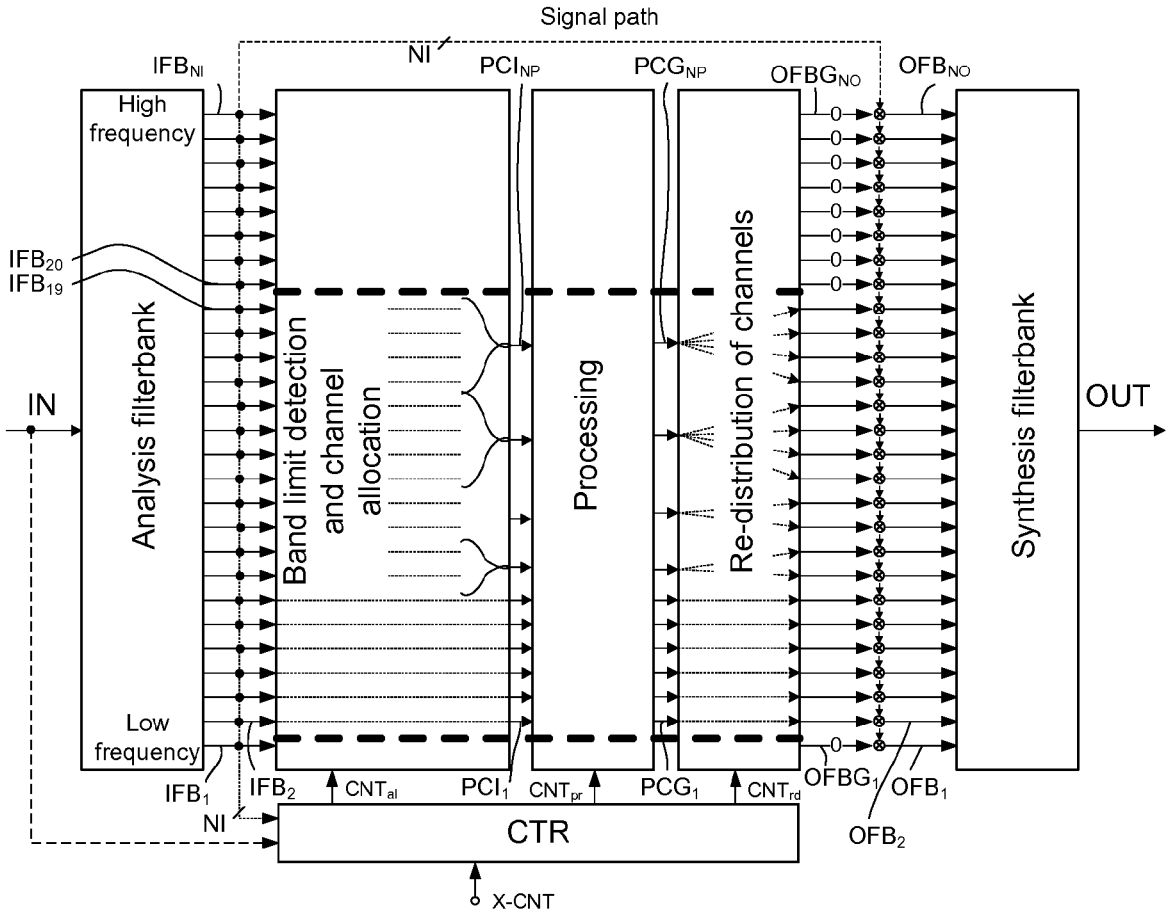
FIG. 3 shows an embodiment of an audio processing device according to the present disclosure.

FIG. 3 shows an embodiment of an audio processing device according to the present disclosure. The embodiment of FIG. 3 is similar to that of FIG. 2 in that it comprises the same functional blocks and the same signal connections between the blocks. In the embodiment of FIG. 3, however, only a part [$f_{PC,min}$; $f_{PC,max}$] of the frequency range [$f_{IN,min}$; $f_{IN,max}$] of the input signal IN (or alternatively stated, only some of the input frequency bands, $IFB_{m1}$ to $IFB_{m2}$, here $IFB_2$ to $IFB_{19}$) are allocated to the available processing channels ($PCh_1$, $PCh_2$, . . . , $PCh_{NP}$). This provides a possibility to focus the available processing channels on the part of the frequency range of the input signal where signal energy of interest to a user is present. In the exemplary embodiment of FIG. 3, the input signal bandwidth of interest (e.g. from a telephone line) lies in the $2^{nd}$ to $19^{th}$ input frequency band ($IFB_2$ to $IFB_{19}$), whereas the rest of the input frequency bands ($IFB_1$ and $IFB_{20}$ to $IFB_{NI}$) are left unused (unprocessed). The outputs of processing channels $PCh_1$, $PCh_2$, . . . , $PCh_{NP}$, providing resulting processing channel gain values ($PCG_1$, $PCG_2$, . . . , $PCG_{NP}$), are 'redistributed' to output band gain values ($OFBG_1$ to $OFBG_{NO}$). The input band to processing channel allocation is mirrored in the processing channel to output band redistribution in that output channels $OFB_1$ and $OFB_{20}$ to $OFB_{NO}$ are void of content. This is indicated in FIG. 3 by '0's on the corresponding output frequency band gain factors $OFBG_j$. In practice, processing (e.g. anti-feedback, noise reduction, level compression, directionality, etc., e.g. performed in block Processing in FIG. 3) of signals in the corresponding frequency bands can be omitted, thereby saving power. The band allocation controlled by the control unit CTR is e.g. dependent on the bandwidth of the input signal IN and/or on a user's hearing profile. Instead of a band allocation as shown in FIG. 3, where some channels contain more than one input band, a 1:1 band to channel allocation may alternatively be used. In this case, the number of channels is determined by the number of input bands, which covers the frequency range of interest of the input signal.

Figure 4A:
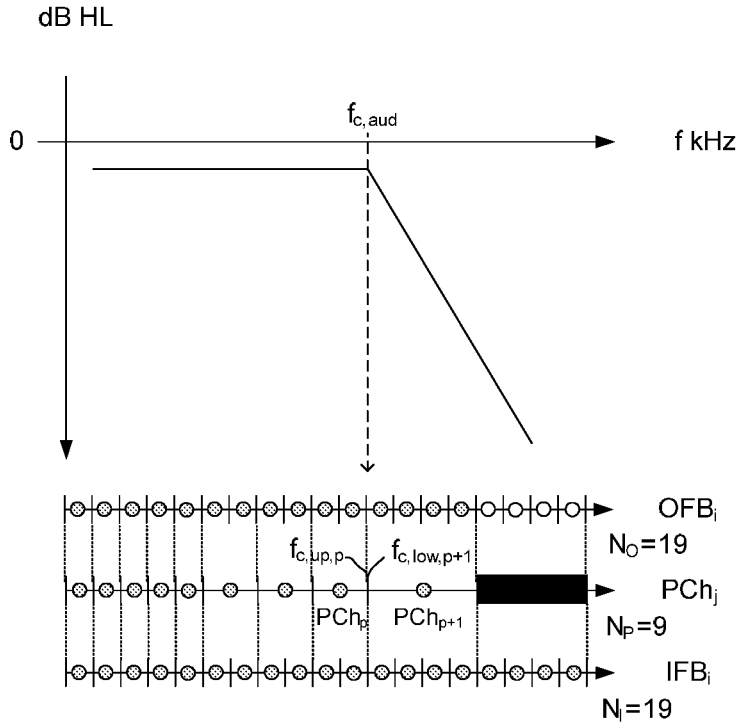
FIG. 4 shows two exemplary band coupling schemes for two particular hearing profiles.
Figure 4B:
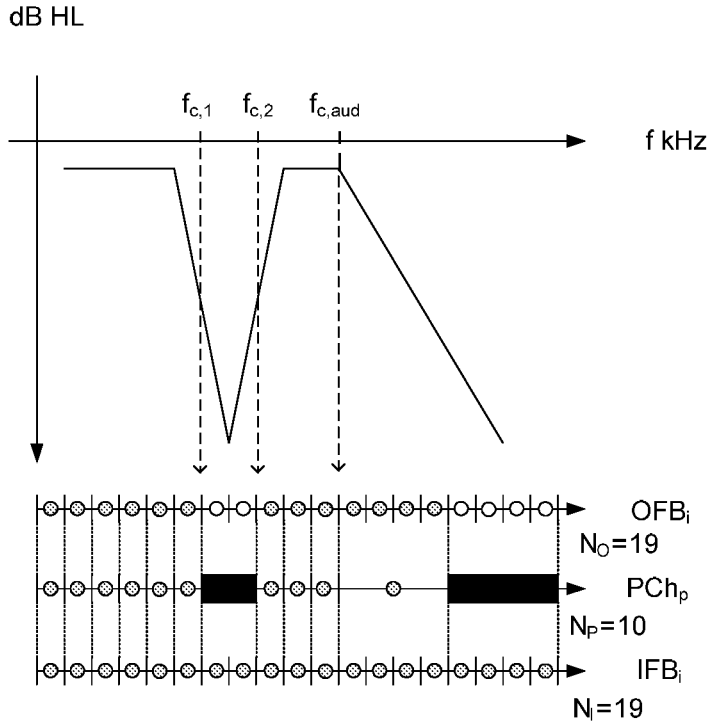

FIG. 4 shows two exemplary band coupling schemes for two particular hearing profiles. FIG. 4*a* shows an example of a hearing profile or audiogram (top part of drawing) for a user having a so-called SKI-slope hearing loss, i.e. a steep decline in hearing ability (dB HL) at specific frequencies, here indicated from a specific frequency $f_{c,aud}$ (e.g. 3 kHz) and upwards in frequency. In the bottom part of FIG. 4*a*, the allocation of input bands $IFB_i$ to processing channels $PCh_p$ and the redistribution of processing channels $PCh_p$ to output bands $OFB_i$ are schematically illustrated and related to the hearing profile of the top part of FIG. 4*a*. The allocation of input frequency bands $IFB_i$ to processing channels $PCh_p$ is controlled according to the user's hearing impairment, here according to the hearing profile (audiogram). Processing channels are preferably allocated to input and output bands so that cut-off frequencies of two adjacent channels are located relatively close to a 'cut-off frequency' of the user's audiogram. In the example of FIG. 4*a*, the upper cut-off frequency $f_{c,up,p}$ of channel $PCh_p$ coincides with the lower cut-off frequency $f_{c,low,p+1}$ of the neighboring channel $PCh_{p+1}$ and the frequency $f_{c,aud}$, where the user's hearing ability starts to decline. In the schematic illustration of band allocation of FIG. 4*a*, the number of input bands $N_I$ is equal to the number of output bands $N_O$=19 bands, whereas the number of processing channels $N_P$ is equal to 9. The total number of bands and channels may in general be adapted to the application in question. Typically the number of input and output bands is a power of 2, e.g. 16 or 32 or 64 or 128, etc. The 5 lowest frequency bands are in the present example allocated to each their processing channel, whereas for the following 6 frequency bands, two frequency bands are allocated to one processing channel. The next 4 bands are allocated to one channel, whereas the last 4 bands are not allocated to any processing channel (because the user in question has no or very little hearing ability at frequencies corresponding to these frequency bands), as indicated by the black rectangle on the processing channel axis $PCh_j$. The shaded circles in the input and output bands and processing channels in the lower part of FIG. 4*a* (and correspondingly in FIG. 4*b*, FIG. 5 and FIG. 6) are intended to indicate that the band or channels in question contain a signal component of interest, whereas an open circle is intended to indicate that the contents of the corresponding band or channel is void or uninteresting and/or unprocessed.

FIG. 4*b* shows another (schematic) example of a hearing profile of a user, where, in addition to a steep decline in hearing ability (dB HL) above a specific frequency $f_{c,aud}$ as in FIG. 4*a*, a degraded hearing ability in a specific frequency range is present. In the schematic illustration of band allocation of FIG. 4*b*, the number of input bands $N_I$ is equal to the number of output bands $N_O$=19 bands, whereas the number of processing channels $N_P$ is equal to 10. The 6 lowest frequency bands are allocated to each their processing channel. The two frequency bands between frequencies $f_{c,1}$ and $f_{c,2}$ representing the frequency range of severely degraded hearing ability of the user are thus not allocated to any processing channel. The subsequent 3 frequency bands are again allocated to each their processing channel, whereas the next 4 bands are allocated to one channel. The last 4 bands are not allocated to any processing channel (because the user in question has no or very little hearing ability at frequencies corresponding to these frequency bands). The frequency ranges, which are not allocated to a processing channel are indicated by the black rectangles on the processing channel axis $PCh_p$.

Figure 5A:
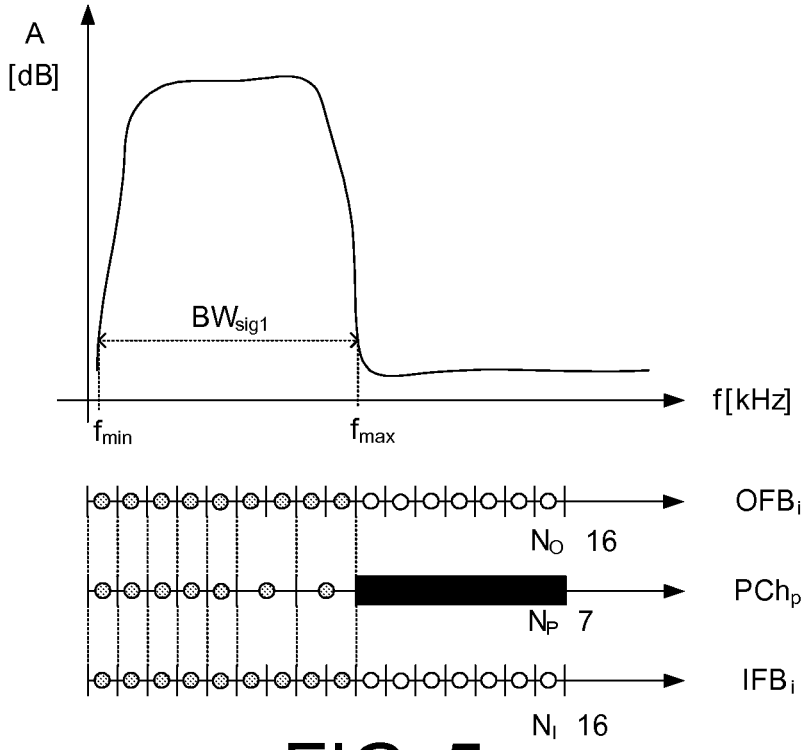
FIG. 5 shows two exemplary band coupling schemes for two different input signal bandwidths.
Figure 5B:
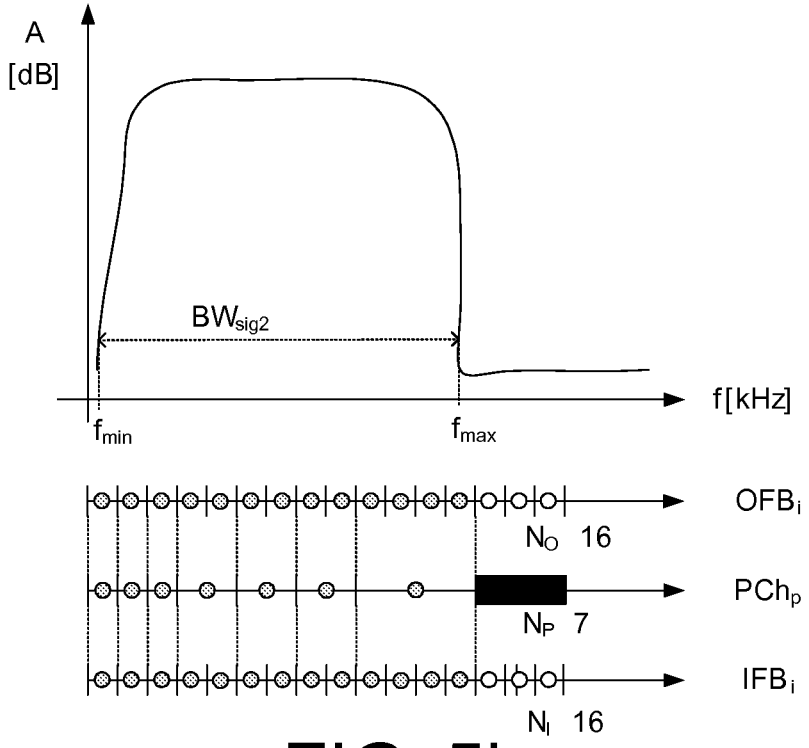

FIG. 5 shows two exemplary band coupling schemes for two different input signal bandwidths. FIG. 5 is a schematic example of a dynamic allocation of input frequency bands to processing channels based on characteristics of the input signal. In this particular case, characteristics of the input signal comprise a bandwidth $BW_{sig}$ (between a lower or minimum frequency $f_{min}$ and an upper or maximum frequency $f_{max}$) where (e.g. 99% of) a desired part of the signal is located. Two examples of signal magnitude vs. frequency covering the frequency of operation of the audio processing device in question are shown in FIGS. 5*a* and 5*b*. FIG. 5*a* shows a first band allocation for an input signal having a first bandwidth $BW_{sig1}$, and FIG. 5*b* shows a second band allocation for an input signal having a second, larger bandwidth $BW_{sig2}$. In the example of FIG. 5, the number of input bands $N_I$ is equal to the number of output bands $N_O$=16 bands, and the number of processing channels $N_P$ is kept constant at 7 independent of the bandwidth. In the band allocation of FIG. 5*a*, corresponding to the relatively smaller bandwidth, the 5 lowest frequency bands are allocated to each their processing channel, whereas two frequency bands are allocated to one processing channel for the following 4 frequency bands. The rest of the frequency bands (7 bands) are not allocated to any processing channel (because no information content of interest is located at frequencies corresponding to these frequency bands, as indicated by the black rectangle on the $PCh_p$ axis). In the band allocation of FIG. 5*b*, corresponding to the relatively larger bandwidth, the 3 lowest frequency bands are allocated to each their processing channel, whereas two frequency bands are allocated to one processing channel for the following 6 frequency bands. The next 4 bands are allocated to one channel, whereas the last 3 bands are not allocated to any processing channel. Other strategies for allocating frequency bands to processing channels may of course be implemented depending on the application and/or the particular user in question. Further, the number of processing channels may be varied, e.g. increased with increasing bandwidth. In the example of FIG. 5, starting from FIG. 5*b* with a relatively large bandwidth signal $BW_{sig2}$, a band allocation strategy for a signal with a more narrow bandwidth $BW_{sig1}$ (where $BW_{sig1}$ is a sub-range of $BW_{sig2}$) could be to keep the bandwidth allocation for the (here) lower part of $BW_{sig2}$ equaling $BW_{sig1}$ and deactivating the remaining channel(s). This would in the present case result in a reduction of channels from $N_P$=7 for the wider bandwidth ($BW_{sig2}$) signal to $N_P$=6 for the narrower bandwidth ($BW_{sig1}$) signal. In case a one to one input band to channel allocation strategy is used, the number of processing channels used for a given input signal would be proportional to the bandwidth of the input signal.

Figure 6A:
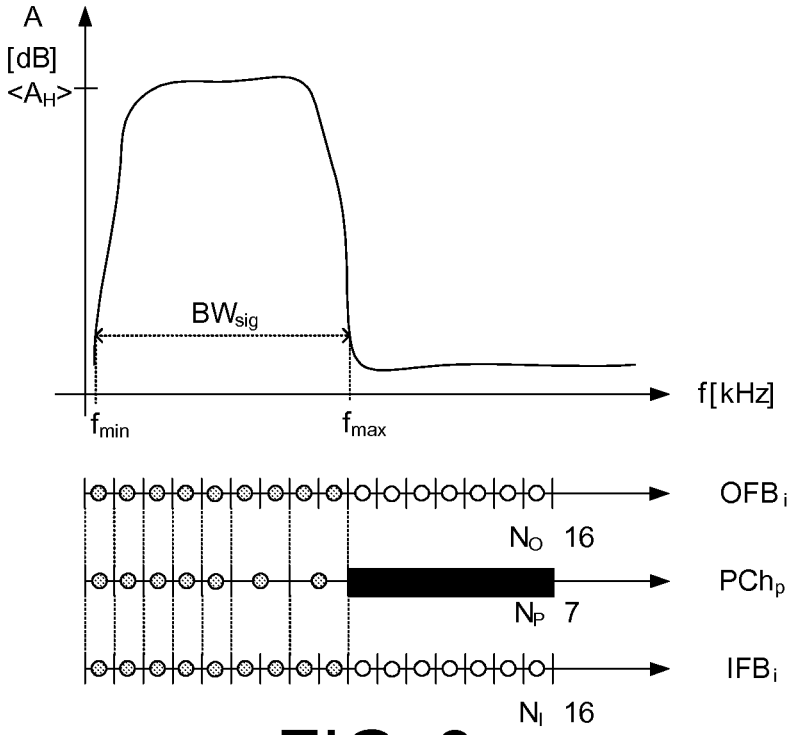
FIG. 6 shows two exemplary band coupling schemes for two different characteristics of the input signal.
Figure 6B:
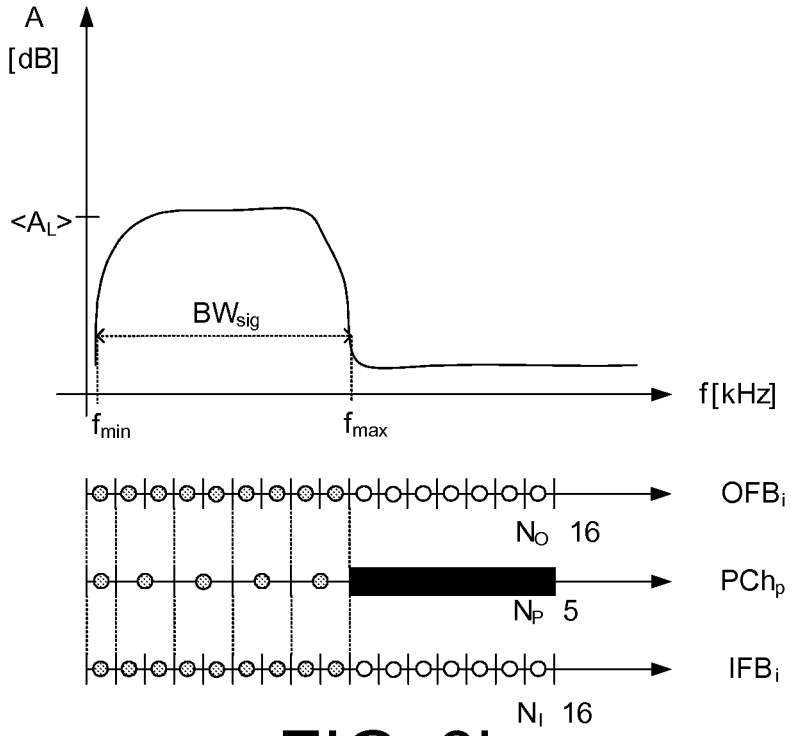

FIG. 6 shows two exemplary band coupling schemes for two different characteristics of the input signal. FIG. 6 is another schematic example of a dynamic allocation of input frequency bands to processing channels based on characteristics of the input signal. In the example of FIG. 6, characteristics of the input signal comprise a (wide band, average) signal level <A>. Two examples of signal magnitude A vs. frequency f covering the frequency of operation of the audio processing device in question are shown in FIGS. 6*a* and 6*b*. The two signals are assumed to have the same bandwidth $BW_{sig}$ (i.e. they have signal content of interest over a signal bandwidth $BW_{sig}$ between a minimum $f_{min}$ and a maximum $f_{max}$ frequency) but different average signal level <A>, the signal of FIG. 6*a* having a relatively higher average signal level $<A_H>$ and the signal of FIG. 6*b* having a relatively lower average signal level $<A_L>$. The levels in question are averaged over an appropriate time (e.g. related to the expected variation over time). In an embodiment, averaging is done over a number of time frames of the signal (e.g. 1 or more), e.g. more than 10 or more than 50 time frames of the digitized signal in question. In an embodiment, averaging is done over more than 100 ms, e.g. over more than 1 s. In the example of FIG. 6, the number of input bands $N_I$ is equal to the number of output bands $N_O$=16 bands as in the example of FIG. 5. The number of processing channels $N_P$ are, however, level dependent, $N_P$=7 (relatively higher) for the relatively higher average signal level $<A_H>$, and $N_P$=5 (relatively lower) for the relatively lower average signal level $<A_L>$. In the band allocation of FIG. 6*a*, corresponding to the relatively higher average signal level $<A_H>$, the 5 lowest frequency bands are allocated to each their processing channel, whereas two frequency bands are allocated to one processing channel for the following 4 frequency bands. The rest of the frequency bands (7 bands) are not allocated to any processing channel (because no information content of interest is located at frequencies corresponding to these frequency bands, as indicated by the black rectangle on the $PCh_p$ axis). In the band allocation of FIG. 6*b*, corresponding to the relatively lower average signal level $<A_L>$, the lowest frequency band is allocated 1:1 to a processing channel, whereas two frequency bands are allocated to one processing channel for the following 8 frequency bands. The last 7 bands are not allocated to any processing channel. Other strategies for allocating frequency bands $IFB_i$, $OFB_i$ to processing channels $PCh_p$ may of course be implemented depending on the application and/or the particular user in question. Further, the number of processing channels $N_P$ may be held constant independent of the detected (wide band) level. Other characteristics than (wideband) level can be used to influence the band allocation at a given time, e.g. modulation index or a detection of speech, a detection of music, etc. Alternatively, the frequency resolution may be reversed, so that the relatively low level input signal of FIG. 6*b* is processed in more processing channel than the relatively high level input signal of FIG. 6*a*. This would make sense, if both signals were of interest to the user (e.g. speech or music) but the relatively high level input signal was too loud.

Figure 7A:
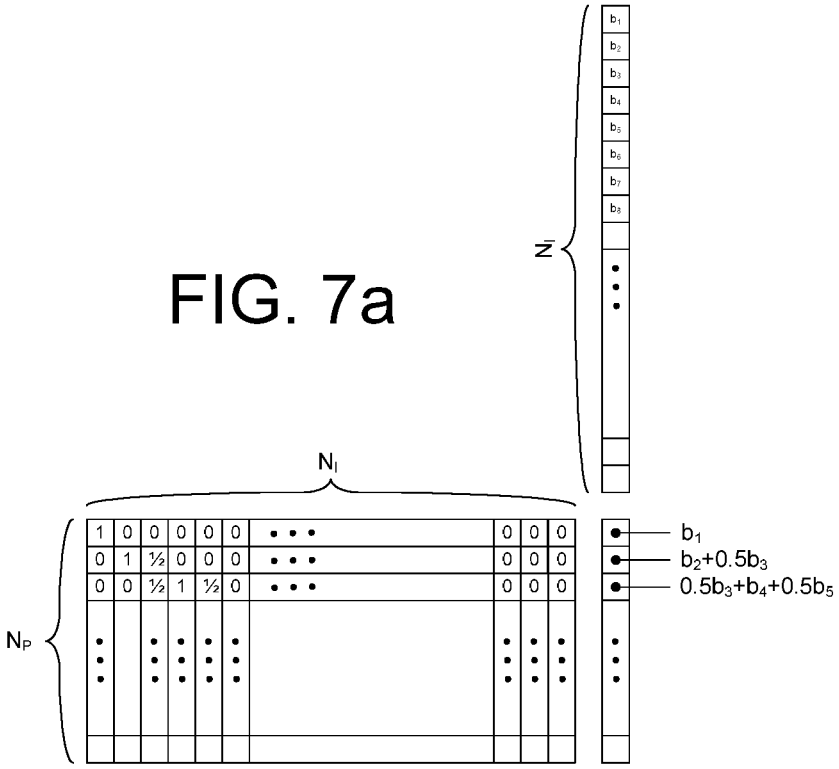
FIG. 7 illustrates an exemplary technique for coupling a number of input bands to a (smaller) number of processing channels, and for re-distributing the processing channels to a (larger) number of output frequency bands.
Figure 7B:
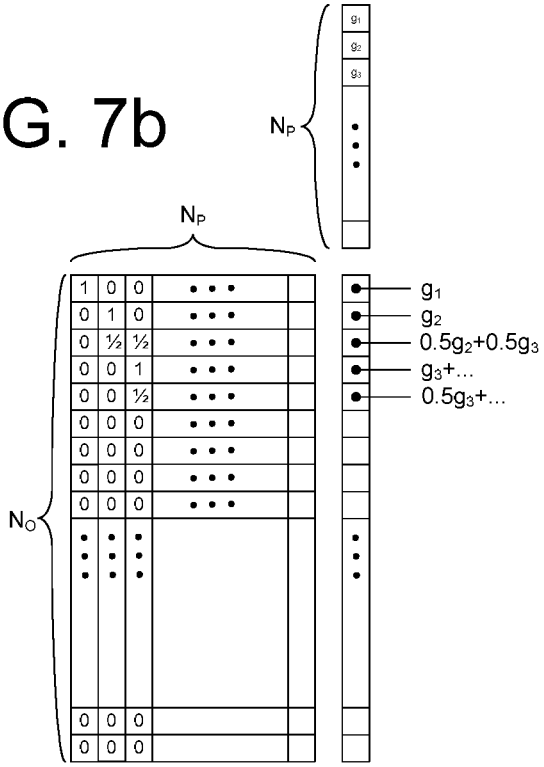

FIG. 7*a* illustrates an exemplary technique for coupling a number of input bands to a (smaller) number of processing channels and FIG. 7*b* illustrates the corresponding redistribution of processing channels to output bands. The $N_I$ input bands generated by the analysis filterbank (cf. e.g. FIG. 2, 3) can be combined to $N_P$ processing channels by multiplying a ($N_P \times N_j$) band coupling matrix $B_I$ with a vector b containing the $N_I$ bands and hereby obtaining a vector c containing the $N_P$ combined channels, i.e.

$$c=B_I b,$$

where $b=[b_1, b_2, \ldots, b_{NI}]^T$. The elements $b_i$ of vector b may correspond to input bands $IFB_i$. of FIG. 1-3. The elements $c_j$ of vector c may correspond to input signals $PCI_j$ of processing channels $PCh_j$ of FIGS. 2 and 3.

Each of the elements $b_i$ and $c_j$ of the vectors b and c, respectively, typically consist of a complex number representing a magnitude and phase of the signal in the corresponding band or channel at a given point in time (e.g. corresponding to a specific time frame).

The sum of each row in $B_I$ may or may not be equal to one. Typically some sort of normalization or calibration of the channel signals is performed. In the exemplary embodiment of FIG. 7*a* the first three elements ($c_1$, $c_2$, $c_3$) of the channel vector $c=[c_1, c_2, c_3, \ldots, c_{NP}]$ are $$c_1=b_1\cdot 1+b_2\cdot 0+b_3\cdot 0+\ldots+b_{NI}\cdot 0=b_1$$

$$c_2=b_1\cdot 0+b_2\cdot 1+b_3\cdot \tfrac{1}{2}+\ldots+b_{NI}\cdot 0=b_2+\tfrac{1}{2}b_3$$

$$c_3=b_1\cdot 0+b_2\cdot 0+b_3\cdot \tfrac{1}{2}+b_4\cdot 1+b_5\cdot \tfrac{1}{2}\ldots+b_{NI}\cdot 0=\tfrac{1}{2}b_3+b_4+\tfrac{1}{2}b_5$$

Fading bands from one channel configuration to another channel configuration (e.g. at a program shift) can e.g. be implemented by—for a given row in $B_1$—slowly (over time) changing the weights from one column to another column (e.g. by changing the weight a little every time frame or every $10^{th}$ time frame or the like). Such fading has the advantage of minimizing artifacts that would otherwise be introduced by an abrupt change of the band coupling. Time constants for fading from one band allocation to another can e.g. be of the order of 1 to 10 s, e.g. depending on the degree of change of the band allocation.

FIG. 7*b* illustrates the corresponding redistribution of processing channels to output bands. The $N_P$ processing channels are redistributed to $N_O$ output bands in a channel redistribution unit (cf. e.g. FIG. 2, 3) by multiplying a ($N_O \times N_P$) channel re-distribution matrix $B_O$ with a vector g containing the $N_P$ processing channel gains and hereby obtaining a vector o containing the $N_O$ output bands, i.e.

$$o=B_O g,$$

where $g=[g_1, g_2, \ldots, g_{NP}]^T$. The elements g, of vector g may correspond to processing channel gains $PCG_j$ of FIG. 2, 3. The elements $o_i$ of vector o may correspond to output frequency band gains $OFBG_i$ of FIGS. 2 and 3.

Figure 8:
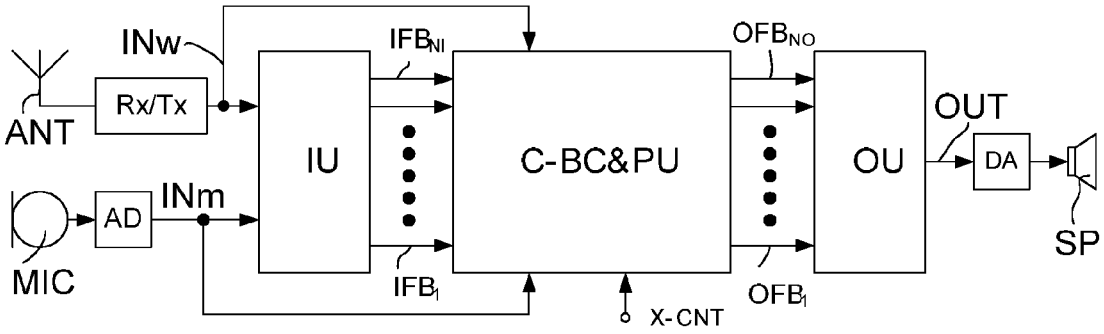
FIG. 8 shows an embodiment of a hearing instrument comprising an audio processing device.

FIG. 8 shows a hearing instrument comprising an embodiment of an audio processing device. The hearing instrument comprises the same elements as the embodiment of an audio processing device shown in FIG. 1*a* and as described above. The hearing instrument further comprises a microphone (MIC) for picking up a sound signal from the environment and an antenna (ANT) and wireless transceiver (Rx/Tx) for receiving and/or transmitting an audio and/or a control signal. The microphone signal is sampled and digitized in an analogue to digital converter (AD) whose output INm is fed to the input unit (IU) as well as to the control and processing unit (C-BC&PU). The wireless transceiver (Rx/Tx) comprises an analogue to digital converter to provide that the output INw of the transceiver is a digital signal, which is fed to the input unit (IU) as well as to the control and processing unit (C-BC&PU). The input unit (IU) is adapted to select (or mix) between the inputs INm and INw from the microphone and the wireless transceiver, respectively, and split the input signal in question (or a mixture thereof) into a number $N_I$ of input bands. The control and processing unit (C-BC&PU) is adapted to receive (extract) and use possible control signals present in the wirelessly received input signal in the processing of the input signal, e.g. as an input to the control of the band allocation at a given point in time, e.g. in a channel allocation unit. The wireless signal may e.g. be received from a contralateral hearing instrument of a binaural hearing aid system, or from a remote control for the hearing instrument, or from an audio gateway associated with the hearing instrument. The control and processing unit (C-BC&PU) may e.g. be structured as shown in FIG. 1*b*, 1*c*, 2 or 3. The hearing instrument further comprises a digital to analogue converter (DA) for converting the digital output OUT of the output unit (OU) to an analogue signal, which is connected to a speaker (SP) for converting an analogue electric output signal to a sound signal. The hearing instrument may comprise other functionality, e.g. feedback cancellation, level compression, noise reduction, etc. Such functionality, which is typically implemented by software algorithms, may e.g. be executed in the control and processing unit (C-BC&PU) or elsewhere as the case may be.

FIG. 9 shows an example of an audio processing device comprising a calibration unit. The Calibration unit comprises a level detector for a particular processing channel $PCh_p$. The level detector comprises an ABS unit for determining the magnitude of the input signal $PCI_p$. The output of the ABS unit is connected to a combination unit (here a multiplication unit '×') for being multiplied with a calibration constant adapted to the energy content of the channel in question (and thus dependent on the allocation of input bands to processing channels). The calibration constant is provided by a calibration unit CAL-F, which receives an appropriate calibration value for the current band allocation from the memory MEM and controlled by a control signal $CNT_{cal}$ from the control unit CTR. The (calibrated) output of multiplication unit is connected to a level estimation unit LEST for estimating the current level $LCh_P$ of the $p^{th}$ channel. This level is fed to the processing unit (Processing) for use in the processing of the channel input signal $PCI_p$, e.g. noise reduction (e.g. level compression).

The memory (MEM) comprises stored values of calibration constants corresponding to the various band allocation configurations used in the application in question. Such table can e.g. be stored in the audio processing device during its manufacture or in a later adaptation process, e.g. a customization to a particular user (e.g. a fitting process for a hearing instrument). In an embodiment, the different predefined band allocation schemes (or a part of them) are defined by a classification of the type of signal (e.g. speech or music or telephone conversation, etc.) and e.g. defined (selected) by corresponding (automatic or user initiated) program selection. In an embodiment, different time constants are allocated to different level estimators depending on the band allocation (and thus e.g. choice of program). In such case, corresponding sets of calibration constants for given band allocations and level estimation time constants are stored in the memory. Appropriate calibration constants (and time constants) can then be read and used when the corresponding band allocation is activated (e.g. when a program using that band allocation is activated).

In the embodiment of FIG. 9, exemplary calibration elements for a single channel (here $PCh_p$) are indicated. It is to be understood that corresponding elements are implemented for other channels (at least for such channels, where calibration is important), e.g. for all channels. It is further indicated that the complex input signal of each channel may be forwarded to the processing part, e.g. as input to a directionality algorithm.

In the embodiment of FIG. 9, an ABS function is used for generating a magnitude of the typically complex input signal $PCI_p$. It may alternatively be an $ABS^2$ function. Similarly, in the embodiment of FIG. 9, the output of the CAL-F unit providing an appropriate calibration constant for the current band allocation is multiplied with the output of the ABS (or $ABS^2$) unit. If a logarithmic representation of the ABS (or $ABS^2$) values is used, the multiplication unit ('×') should be substituted by a sum-unit ('+'). Likewise, the calibration constant unit (CAL-F) and corresponding combination unit ('+' or '×') may be located elsewhere, e.g. after the estimation unit (LEST).

The resulting output of the level estimation unit (LEST) is a (calibrated) level estimate of the channel in question. In the Processing block, various processing algorithms may be applied to the channel signal, e.g. a noise reduction algorithm where the input level (or a parameter derived therefrom) is converted to a resulting gain via an I/O-mapping function (see e.g. WO 2005/086536 A1).

In a typical calibration procedure, a simulation is made wherein Gaussian noise of a specific level (e.g. 65 dB) is fed into the audio processing device, e.g. a hearing instrument. In addition to calibrating the input and output signals, several internal signals have to be calibrated to ensure that a predetermined intended level is reflected by the signal in question (e.g. in different frequency bands). The measured values depend e.g. on the band coupling in question and on time constants of the sensors (e.g. a level detector), so if these change, the calibration values must be adapted, to provide that the measured values remain the same.

Such calibration values can be numerically calculated, or analytically, e.g. based on a noise signal that with a Gaussian probability density distribution of its amplitude.

An analytical calculation of calibration values may be made in advance to provide sets of calibration constants for a given predefined parameter settings and band coupling configurations. Alternatively, an algorithm for calculating a set of calibration constants for a given situation may be stored and executed in the audio processing device (or a device with which it can communicate), when a new band allocation is activated in the audio processing device. The latter has the advantage that the storage of a number of different sets of calibration values is not necessary; only the algorithm needs to be stored.

Figure 10:
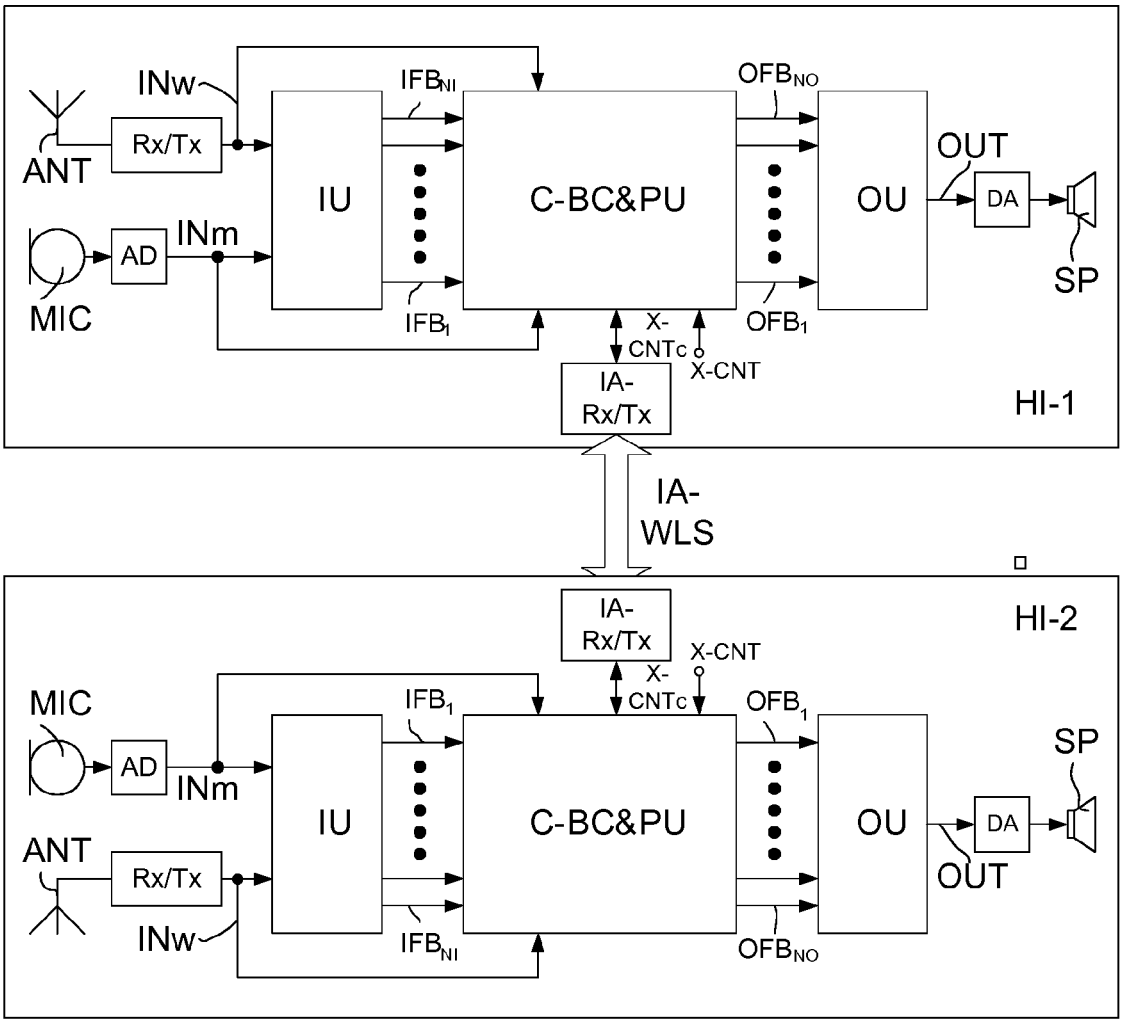
FIG. 10 shows an embodiment of an audio processing system comprising a binaural hearing aid system.

FIG. 10 shows an embodiment of an audio processing system comprising a binaural hearing aid system. The audio processing system comprises two audio processing devices, e.g. constituting a binaural hearing aid system comprising first and second hearing instruments (HI-1, HI-2) adapted for being located at or in left and right ears of a user. The hearing instruments are adapted for exchanging information between them via a wireless communication link, e.g. a specific interaural (IA) wireless link (IA-WLS). The two hearing instruments HI-1, HI-2 are adapted to allow the exchange of status signals, e.g. including the transmission of characteristics of the input signal received by a device at a particular ear to the device at the other ear. To establish the inter-aural link, each hearing instrument comprises antenna and transceiver circuitry (here indicated by block IA-Rx/Tx). Each hearing instrument HI-1 and HI-2 is an embodiment of an audio processing device as described in the present application, here as described in connection with FIG. 8. In the binaural hearing aid system of FIG. 10, a control signal X-CNTc generated by a control part of the control and processing unit (C-BC&PU) of one of the hearing instruments (e.g. HI-1) is transmitted to the other hearing instrument (e.g. HI-2) and/or vice versa. The control signals from the local and the opposite device are used together to influence a decision on band allocation in the local device. The control signals may e.g. be used to classify the current acoustic environment of the user wearing the hearing instruments. In an embodiment, the audio processing system further comprises an audio gateway device for receiving a number of audio signals and for transmitting at least one of the received audio signals to the audio processing devices (hearing instruments) (see e.g. EP 1 460 769 A1 or WO 2009/135872 A1). In an embodiment, the audio processing system is adapted to provide that a telephone conversation can be received in the audio processing device(s) via the audio gateway. In such case an information about the bandwidth of the current audio signal can conveniently be transmitted to the audio processing device(s) from the audio gateway along with (e.g. in advance of or embedded in) the audio signal in question. Alternatively to a telephone conversation, another audio signal (of varying signal quality (e.g. bandwidth)) can be forwarded (e.g. streamed) from the audio gateway to the audio processing device(s).

The invention is defined by the features of the independent claim(s). Preferred embodiments are defined in the dependent claims. Any reference numerals in the claims are intended to be non-limiting for their scope.

Some preferred embodiments have been shown in the foregoing, but it should be stressed that the invention is not limited to these, but may be embodied in other ways within the subject-matter defined in the following claims.

The invention claimed is:

1. An audio processing device, comprising:

a) an input unit for converting a time domain input signal to a number $N_I$ of input frequency bands;

b) an output unit for converting a number $N_O$ of output frequency bands to a time domain output signal;

c) a signal processing unit adapted to process the input frequency bands in a number $N_P$ of processing channels, the number $N_P$ of processing channels being smaller than the number $N_I$ of input frequency bands;

d) a frequency band allocation unit for allocating the input frequency bands to the processing channels;

e) a frequency band redistribution unit for redistributing the processing channels to the output frequency bands; and f) a control unit for dynamically controlling the allocation of the input frequency bands to the processing channels and the redistribution of the processing channels to the output frequency bands.

2. An audio processing device according to claim 1 wherein the control unit comprises a classification unit for identifying characteristics of the input signal.

3. An audio processing device according to claim 2 wherein characteristics of the input signal comprise its bandwidth.

4. An audio processing device according to claim 2 wherein the frequency band allocation unit is adapted to allocate input bands to processing channels dependent on characteristics of the input signal.

5. An audio processing device according to claim 1 wherein the audio processing device comprises a memory storing a number of sets of selectable processing parameters optimized for processing different types of input audio signals, wherein the number $N_P$ of processing channels is fixed for a given set of processing parameters.

6. An audio processing device according to claim 5 wherein the number $N_P$ of processing channels is different for at least two sets of different processing parameters.

7. An audio processing device according to claim 1 wherein the number $N_P$ of processing channels is adapted to a user's hearing impairment.

8. An audio processing device according to claim 1 wherein the number $N_P$ of processing channels is dynamically adapted during normal use of the audio processing device.

9. An audio processing device according to claim 1 wherein the number $N_P$ of processing channels is fixed during normal operation of the audio processing device.

10. An audio processing device according to claim 1 wherein the frequency band allocation unit is adapted to allocate input bands to processing channels according to a user's hearing impairment.

11. An audio processing device according to claim 10 wherein a processing channel $PCh_p$ has lower $f_{c,low,p}$ and upper $f_{c,up,p}$ cut-off frequencies, p=1, 2, . . . , $N_P$, and wherein the frequency band allocation unit is adapted to locate cut-off frequencies of processing bands dependent on a user's hearing impairment.

12. An audio processing device according to claim 1 wherein the audio processing device comprises a memory storing a number of sets of selectable processing parameters, wherein the frequency band allocation unit is adapted to allocate input bands to processing channels differently for two different sets of processing parameters.

13. An audio processing device according to claim 1 wherein the number $N_I$ of input frequency bands is equal to the number $N_O$ of output frequency bands.

14. An audio processing device according to claim 1 wherein the input unit comprises an analysis unit for splitting a time variant audio input signal into a number $N_I$ of input frequency bands and the output unit comprises a synthesizer unit for synthesizing a number $N_O$ of output frequency bands into a time variant audio output signal.

15. An audio processing device according to claim 1 adapted to provide that the frequency range represented by the number $N_P$ of processing channels is variable.

16. An audio processing device according to claim 1 adapted to provide that individual processing channels can represent frequency ranges of the input signal of different width.

17. An audio processing device according to claim 1 adapted to provide that the number of input frequency bands allocated to different processing channels can be different.

18. An audio processing device according to claim 1 adapted to provide that neighboring input frequency bands and/or processing channels and/or output frequency bands mutually overlap in frequency.

19. An audio processing device according to claim 1, wherein the frequency band allocation unit is adapted to gradually change a first band allocation to a second band allocation, when it has been decided to change the present allocation of input bands to processing channels.

20. An audio processing device according to claim 1 comprising a memory storing a number of constants or parameters associated with different band coupling schemes to allow an appropriate re-calibration of estimators and sensors after a change of band coupling.

21. An audio processing device according to claim 1 comprising a memory storing an algorithm for calculating a set of calibration constants for a given situation.

22. An audio processing device according to claim 1, comprising:

a listening device.

23. A audio processing device according to claim 22 comprising an ITE-part adapted for being placed in the ear of a user, the ITE-part comprising a vent with a variable cross-sectional area, wherein the frequency band allocation unit of the audio processing device is adapted to allocate input bands to processing channels dependent on the cross-sectional area of the vent.

24. An audio processing system, comprising:

two or more audio processing devices according to claim 1, wherein the audio processing devices are adapted for exchanging information between them via a communication link.

25. An audio processing system according to claim 24 comprising a binaural hearing aid system comprising first and second audio processing devices in the form of first and second hearing instruments, respectively, adapted for being located at or in left and right ears of a user.

26. An audio processing system according to claim 24 wherein the audio processing devices are adapted to transmit to and receive from a respective other device level-estimates and/or bandwidth estimates and/or modulation characteristics of the received input audio signals of the device(s) in question.

27. An audio processing system according to claim 24 adapted to provide that the same band coupling scheme is applied in both devices of a binaural system by exchanging synchronizing control signals between the two devices.

28. An audio processing system according to claim 24 further comprising an audio gateway device for receiving a number of audio signals from a number of different audio sources and for transmitting a selected one of the received audio signals to the audio processing devices.

29. A method of processing an input audio signal, comprising:

a) providing the input signal in a number $N_I$ of input frequency bands;

b) allocating the number $N_I$ of input frequency bands to a number $N_P$ of processing channels, each of the $N_P$ processing channels carrying a channel input signal, the number $N_P$ of processing channels being smaller than the number $N_I$ of input frequency bands;

c) processing the number $N_P$ of channel input signals and providing a number $N_P$ of channel output signals;

d) redistributing the number $N_P$ of processing channels to a number $N_O$ of output frequency bands, wherein the allocation of the input frequency bands to the processing channels and the redistribution of the processing channels to the output frequency bands are dynamically controlled.

30. A method according to claim 29 comprising converting a time domain input signal into the number $N_I$ of input frequency bands and/or converting the number $N_O$ of output frequency bands to a time domain output signal.

31. A non-transitory tangible computer-readable medium encoded with instructions for causing a data processing system to perform the steps of the method of claim 29, when said instructions are executed on the data processing system.

* * * * *